US007722176B2

(12) United States Patent
Nishioka et al.

(10) Patent No.: US 7,722,176 B2
(45) **Date of Patent: *May 25, 2010**

(54) INK TANK AND INK JET PRINTER

(75) Inventors: Atsushi Nishioka, Nagano (JP); Yukihiro Hanaoka, Nagano (JP); Manabu Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/390,182

(22) Filed: Feb. 20, 2009

(65) Prior Publication Data

US 2009/0160888 A1 Jun. 25, 2009

Related U.S. Application Data

(63) Continuation of application No. 11/832,795, filed on Aug. 2, 2007, now Pat. No. 7,513,614, which is a continuation of application No. 11/400,386, filed on Apr. 10, 2006, now Pat. No. 7,252,377, which is a continuation of application No. 11/045,059, filed on Jan. 31, 2005, now Pat. No. 7,029,106, which is a continuation of application No. 10/366,702, filed on Feb. 14, 2003, now Pat. No. 6,848,776.

(30) Foreign Application Priority Data

Feb. 14, 2002 (JP) ..... P2002-037431
May 15, 2002 (JP) ..... P2002-139840

(51) Int. Cl.
*B41J 2/175* (2006.01)

(52) U.S. Cl. ..... 347/86

(58) Field of Classification Search ..... 347/7, 347/19, 85, 86, 87
See application file for complete search history.

(56) References Cited

U.S. PATENT DOCUMENTS 4,246,489 A 1/1981 Yoshida et al.

(Continued)

FOREIGN PATENT DOCUMENTS

JP 6-305162 11/1994

(Continued)

OTHER PUBLICATIONS

Patent Abstract of Japan, vol. 1998, No. 14, Dec. 31, 1998 and JP 10 232157 A (Canon Inc.).

*Primary Examiner*—Anh T. N. Vo
(74) *Attorney, Agent, or Firm*—Nixon & Vanderhye P.C.

(57) ABSTRACT

An ink tank of the foam type which is provided with a detected portion capable of exactly and surely detecting the amount of ink used by the printer or remaining in the ink tank. The ink tank includes a sub ink chamber that is disposed or formed between a main ink chamber and an ink outlet of an ink tank of a foam type. When an amount of air flowing into the sub ink chamber increases, one or more reflecting surfaces of a right-angled prism, which function as ink interfaces, resume their original function of reflecting surfaces, thereby enabling the detection of an ink end. Air bubbles having entered the sub ink chamber are surely led onto the one or more reflecting surfaces by a bubble storage part. At an ink passage having a narrow width, which is defined by the one or more reflecting surfaces, air bubbles are pressed against the one or more reflecting surfaces to be put to a crushed state and in surface contact with the latter. Air bubbles are surely led onto the one or more reflecting surfaces, and are crushed and pressed against the reflecting surfaces. This configuration prevents the one or more reflecting surfaces from being covered with ink retained in spaces among the air bubbles. Therefore, the ink end can be detected surely and exactly.

11 Claims, 15 Drawing Sheets

U.S. PATENT DOCUMENTS

| | | | | |
|---|---|---|---|---|
| 5,616,929 | A | 4/1997 | Hara | |
| 5,790,157 | A | 8/1998 | Higuma et al. | |
| 5,841,455 | A * | 11/1998 | Tanaka et al. | 347/87 |
| 5,997,121 | A | 12/1999 | Altfather et al. | |
| 6,012,795 | A | 1/2000 | Saito et al. | |
| 6,145,972 | A | 11/2000 | Udagawa et al. | |
| 6,234,603 | B1 | 5/2001 | Altfather et al. | |
| 6,257,712 | B1 * | 7/2001 | Haigo | 347/85 |
| 6,361,136 | B1 | 3/2002 | Watanabe et al. | |
| 6,394,590 | B1 | 5/2002 | Koitabashi et al. | |
| 6,409,302 | B2 | 6/2002 | Altfather et al. | |
| 6,454,400 | B1 | 9/2002 | Morita et al. | |
| 6,729,711 | B1 | 5/2004 | Hashimoto et al. | |
| 6,805,437 | B2 | 10/2004 | Yamanaka et al. | |
| 6,848,776 | B2 | 2/2005 | Nishioka et al. | |
| 7,029,106 | B2 | 4/2006 | Nishioka et al. | |
| 7,252,377 | B2 | 8/2007 | Nishioka et al. | |
| 2001/0035887 | A1 | 11/2001 | Altfather et al. | |

FOREIGN PATENT DOCUMENTS

| | | |
|---|---|---|
| JP | 6-328717 | 11/1994 |
| JP | 7-125236 | 5/1995 |
| JP | 8-108543 | 4/1996 |
| JP | 8-197743 | 8/1996 |
| JP | 9-174877 | 7/1997 |
| JP | 10-323993 | 12/1998 |
| JP | 11-115200 | 4/1999 |
| JP | 2001-063085 | 3/2001 |
| JP | 2002-205413 | 7/2002 |

* cited by examiner

FORM BUBBLES PERIOD

INK BETWEEN FILTER AND BUBBLE TRAP MEMBER TERMINATED PERIOD

INK BETWEEN FILTER AND BUBBLE TRAP MEMBER TERMINATED PERIOD

BUBBLE DISAPPEARED PERIOD

INK TANK AND INK JET PRINTER

CROSS-REFERENCES TO RELATED APPLICATIONS

This application is a continuation of U.S. patent application Ser. No. 11/832,795, filed Aug. 2, 2007, now U.S. Pat. No. 7,513,614; which is a continuation of U.S. patent application Ser. No. 11/400,386, filed Apr. 10, 2006, now U.S. Pat. No. 7,252,377; which is a continuation of U.S. patent application Ser. No. 11/045,059, filed Jan. 31, 2005, now U.S. Pat. No. 7,029,106; which is a continuation of U.S. patent application Ser. No. 10/366,702, filed Feb. 14, 2003, now U.S. Pat. No. 6,848,776; which claims priority of Japanese Patent Application No. P2002-037431, filed Feb. 14, 2002, and Japanese Patent Application No. P2002-139840, filed May 15, 2002, the entire contents of each of which are hereby incorporated by reference in this application.

BACKGROUND OF THE INVENTION

1. Technical Field

The present invention relates to an ink tank with an ink absorbing member absorptively retaining ink, and more particularly to an ink tank with a detected portion capable of exactly detecting when ink in the ink tank has been depleted, including the amount of ink used or remaining in the ink tank, and an ink jet printer using the ink tank as an ink supplying source.

2. Related Art

An ink tank of a foam type is known for the ink tank of an ink jet printer. The foam type ink tank is composed of a foam containing part containing a foam absorptively retaining ink, an ink outlet communicating with the foam containing part, and an air communication port through which the foam containing part is opened to the air. When ink is sucked through the ink outlet in response to an ejection pressure of the ink jet head, an amount of air corresponding to an amount of sucked ink flows from the air communication port to the foam containing part.

In the case of the foam type ink tank, detection as to whether ink is present is carried out based on a count result, viz., in a manner that an amount of used ink is counted in accordance with the number of ink dots ejected from the ink jet head, and an amount of ink sucked by the ink pump which sucks ink from the ink jet head, or the like.

Generally, a contents state of the ink tank in which little ink is left in the ink tank is called a "real end". A contents state of the ink tank in which an amount of ink left in the ink tank is smaller than a predetermined amount of ink is called a "near end". In the present specification, the term "ink end" involves both the terms "real end" and "near end" unless otherwise stated or indicated.

The ink end detecting method, which counts the amount of used ink and detects the ink end based on the count result, has the following problems. First, some variations are present in the amount of ejected ink in the ink jet head and the amount of ink sucked by the ink pump. An amount of used ink that is counted on the basis of those ink amounts may greatly deviate from the amount of ink actually used. Therefore, the necessity is that a large margin must be set up to definitively determine the ink end state. The result is that at a time point where the ink end is detected, a great amount of ink is often still left, thereby resulting in the waste of ink.

A possible way to solve the problem is that the ink end is directly detected by using an optical detecting system which utilizes the reflecting surface of a prism which resumes its original reflecting surface function when the ink is used up. The detecting system utilizing the prism reflecting surface is disclosed in, for example, JP-A-10-323993 and U.S. Pat. No. 5,616,929.

In the case of the foam type ink tank, the ink is absorptively retained in the foam. Therefore, it is impossible to directly apply the detecting system disclosed in the patent publication to the ink tank. A possible solution to this is that a sub ink chamber of a small capacity, which can store ink, is located between a main ink chamber (foam containing part containing a foam), and the ink outlet. The reflecting surface of the prism is disposed in the sub ink chamber. In a state that a certain amount of ink in the main ink chamber is consumed, air flows into the sub ink chamber.

By so doing, every time ink is supplied through the ink outlet, ink flows from the main ink chamber to the sub ink chamber. As the amount of ink in the main ink chamber becomes small, air bubbles enter the main ink chamber. Over the course of time, the ink in the main ink chamber is used up, and the only ink remaining in the ink tank is the ink stored in the sub ink chamber.

When the amount of ink left in the sub ink chamber is reduced to be small, the reverse surface of the reflecting surface of the prism, which serves as an ink interface, becomes exposed above the ink liquid surface, and a reflecting state of the reflecting surface changes. More particularly, the reverse surface of the prism, which does not function as the reflecting surface when it is covered with ink, gradually resumes its original function of the reflecting surface as the ink liquid level lowers. Accordingly, a state in which the amount of residual ink is smaller than a predetermined amount of ink can be detected based on the amount of light reflected by the reflecting surface. Therefore, if the volume of the sub ink chamber is sufficiently small, the ink end can be detected at a time point where the amount of residual ink is substantially zero.

When air bubbles having entered the sub ink chamber stick to the reverse surface of the prism reflecting surface or stray in the vicinity of the reverse surface, the prism reflecting surface remains covered with ink retained among the air bubbles even if the ink liquid surface lowers to a level below the prism reflecting surface. As a result, a reflecting state of the prism reflecting surface remains unchanged even if the ink liquid surface lowers. As such, a disadvantageous situation in which it is impossible to detect the ink end possibly occurs.

SUMMARY OF THE INVENTION

Accordingly, an object of the invention is to provide an ink tank which can eliminate such an unwanted situation that by the air bubbles in the sub ink chamber, the reflecting state of the reflecting surfaces does not change even if the ink liquid level lowers.

Another object of the invention is to provide an ink jet printer which is capable of exactly and surely detecting an ink end of the ink tank by detecting a reflecting state of the reflecting surfaces of the ink tank.

To solve the problems mentioned above, there is provided an ink tank comprising: an ink absorbing member for absorptively retaining ink therein; a main ink chamber containing the ink absorbing member therein and being opened to the air; an ink outlet; a sub ink chamber including a first sub ink chamber being formed between the main ink chamber and the ink outlet and allowing ink and air bubbles both coming from the main ink chamber to enter the first sub ink chamber per se, a second sub ink chamber, located between the first sub ink chamber and the ink outlet, for reserving the ink, and an ink passage for leading the ink and the air bubbles from the first sub ink chamber to the second sub ink chamber; and a detected portion, disposed at either of the ink passage or the second sub ink chamber, for optically detecting whether the ink is used up on the basis of an amount of air having flowed from the main ink chamber into the sub ink chamber.

In the invention, the sub ink chamber is divided into a first sub ink chamber and a second sub ink chamber, except the ink passage therein to thereby prevent the supply of ink coming from the second sub ink chamber for generating or sustaining the air bubbles in the first sub ink chamber. Accordingly, the breaking of air bubbles stored in the first sub ink chamber is promoted, and the formation of air bubbles by the ink in the first sub ink chamber is prevented. As a result, the detected portion is disposed at the ink passage communicatively connecting the first sub ink chamber to the second sub ink chamber or at the second sub ink chamber. Influence of air bubbles on the detected portion is greatly reduced, and hence, a detection accuracy of the detected portion is greatly improved.

In the invention, the detected portion preferably includes reflecting surfaces of which the reverse surfaces serve as ink interfaces. Further, a part of the ink passage is formed with the reverse surfaces of the reflecting surfaces and opposite surfaces being confronted with the reverse surfaces of the reflecting surfaces while being separated from each other by a predetermined distance. With such a structure, air bubbles having flowed into the first sub ink chamber are led to the reverse surfaces of the reflecting surfaces by the ink passage. Accordingly, the reflecting surfaces, of which the reverse surfaces serve as ink interfaces, are switched from a non-reflecting state to a reflecting state with a high precision in accordance with an amount of air bubbles flowing thereto. Therefore, the ink end is surely detected.

To set the reverse surfaces of the reflecting surfaces to the ink interfaces, a part of the ink passage may be formed with the reverse surfaces of the reflecting surfaces and opposite surfaces being confronted with the reverse surfaces of the reflecting surfaces while being separated from each other by a predetermined distance.

In this case, it is preferable that at the ink passage at which the reverse surfaces of the reflecting surfaces are positioned, the air bubbles having flowed into the first sub ink chamber flow while being crushed.

When a number of air bubbles having flowed into the sub ink chamber stray in the vicinity of the reverse surfaces of the reflecting surfaces, the reverse surfaces of the reflecting surfaces are covered with ink retained among the air bubbles. In this state, even when the sub ink chamber is substantially filled with air bubbles and contains no ink, the reverse surfaces of the reflecting surfaces are covered with ink retained among the air bubbles. Accordingly, the reflecting surfaces still serve as the ink interfaces, and do not function as the reflecting surfaces. As a result, even if ink is used up in the sub ink chamber and an ink end state is set up, the detected portion cannot detect its state. It is noted that in the invention, the air bubbles pass through the ink passage on the reverse surface side of the reflecting surfaces, while being crushed. Accordingly, the air bubbles are forcibly pressed against the reverse surfaces of the reflecting surfaces and put to a surface contact state. For this reason, such a problem that the reverse surfaces of the reflecting surfaces are covered with the ink retained among the air bubbles is avoided, and the ink end state is reliably detected.

In the ink tank, as for a space between the reverse surfaces of the reflecting surfaces and the opposite surfaces, a part of a given width including an incident position of detecting light on the reflecting surface and a part of a given width including a reflecting position of detecting light on the other reflecting surface are wider than that of the remaining part of the ink passage. With this feature, air bubbles surely flow at the incident and reflecting positions of detecting light. Accordingly, the ink end state is reliably detected.

In the ink tank, parts of the ink passage, which are defined by the reverse surfaces of the reflecting surfaces and the opposite surfaces, are formed at only a part of a given width including at least one of an incident position of detecting light on the reflecting surface and a part of a given width including a reflecting position of detecting light on the reflecting surface. This feature also enables sure detection of the ink end, and makes the structure of the detected portion for detecting the ink end simpler.

The reflecting surfaces may be a couple of reflecting surfaces of a prism, which are oriented at a right angle.

The ink tank may further comprise: a main ink chamber side communication port communicatively connecting the main ink chamber with the sub ink chamber; a first filter being mounted on the main ink chamber side communication port and made of a porous material permitting the air bubbles to pass therethrough; an ink outlet side communication port communicatively connecting the second sub ink chamber to the ink outlet; and a second filter being mounted on the ink outlet side communication port and made of a porous material of which fine holes are smaller in diameter than that of the first filter. This characteristic feature prevents air bubbles having flowed into the ink chamber from flowing from the ink outlet to the ink jet head.

The first and second sub ink chambers are defined by a partitioning member mounted within the sub ink chamber. This feature provides an easy molding of a container body of the ink tank.

In the ink tank, an irregular surface for capturing air bubbles generated in a bubble storage part is formed on the upper surface of the partitioning member, which defines the first sub ink chamber.

Air bubbles that are formed by the air coming from the main ink chamber to the first sub ink chamber, together with the ink, will flow in the first sub ink chamber toward the ink passage. However, the air bubbles are captured by the depressions of the irregular surface formed on the surface of the partitioning plate member, and their movement is blocked. When air bubbles are further formed in a state that the air bubbles are not moved, newly formed air bubbles combine with the air bubbles that are captured by the depressions and stand still, to thereby grow air bubbles larger than the newly formed bubbles. As a result, the formation of the air layer in the first sub ink chamber is promoted, and the air bubbles are swiftly separated from the ink liquid surface. Accordingly, such an unwanted situation that the air bubbles flow into the second sub ink chamber, and attach to the reverse surfaces of the reflecting surfaces, and the ink end detection is impossible, is surely avoided.

The irregular surface contains at least one of depressions and protrusions, which are arrayed in such a direction to bend a flow of the air bubbles flowing to the ink passage. With this feature, the flow of air bubbles is surely blocked.

The depressions and the protrusions are alternately arranged on the irregular surface, and the surfaces of the protrusions include parts on which higher second protrusions are formed while being discretely arrayed. With this feature, the air bubbles are reliably captured by the deeper depressions formed among the protrusions and second protrusions. Further, ink may be made to flow through spaces among the discrete second protrusions. Therefore, the air bubbles can reliably be captured, and the amount of residual ink in the irregular surface reduced.

The depressions and/or the protrusions on the irregular surface are arrayed in a zig-zag fashion when viewed in a direction of a flow of air bubbles flowing to the ink introducing hole. With this feature, the air bubbles are reliably captured, and no air bubbles are stored in the irregular surface.

A space between the upper surface and a first filter which separates the main ink chamber from the first sub ink chamber and is made of a porous material permitting the air bubbles to pass therethrough is smaller than a diameter of each air bubble generated in the first sub ink chamber. If so selected, the air bubbles generated in the first sub ink chamber are crushed to be flat. Therefore, the air bubbles are reliably captured on the irregular surface of the partitioning member. The binding of the air bubbles is advantageously facilitated.

In a preferred configuration, a space between an inner peripheral surface of the first sub ink chamber and an outer peripheral surface of the partitioning member is liquid tightly sealed. The reason for this is that if not so sealed, the bubble forming ink is supplied from the ink storage part to the bubble storage part, through the capillary action. Accordingly, separation of the air bubbles from the ink liquid surface by the partitioning member may be hindered.

An ink jet printer using the ink tank defined herein as an ink supplying source, comprises a detecting part for detecting the detected portion of the ink tank. The ink jet printer of the invention surely detects the ink end state.

BRIEF DESCRIPTION OF DRAWINGS

FIG. 16(*b*) is a cross sectional view showing the reflecting surfaces and remain covered with ink retained in the spaces among the air bubbles.

DETAILED DESCRIPTION OF THE INVENTION

Embodiments of an ink tank incorporating the present invention thereinto will be described with reference to the accompanying drawings. In the embodiments to be given hereunder, the invention is incorporated into an ink tank to be detachably attached onto a tank attaching part of an ink jet printer. The invention may also be incorporated in other ways such as into an ink tank preset in the ink jet printer.

Figure 15:
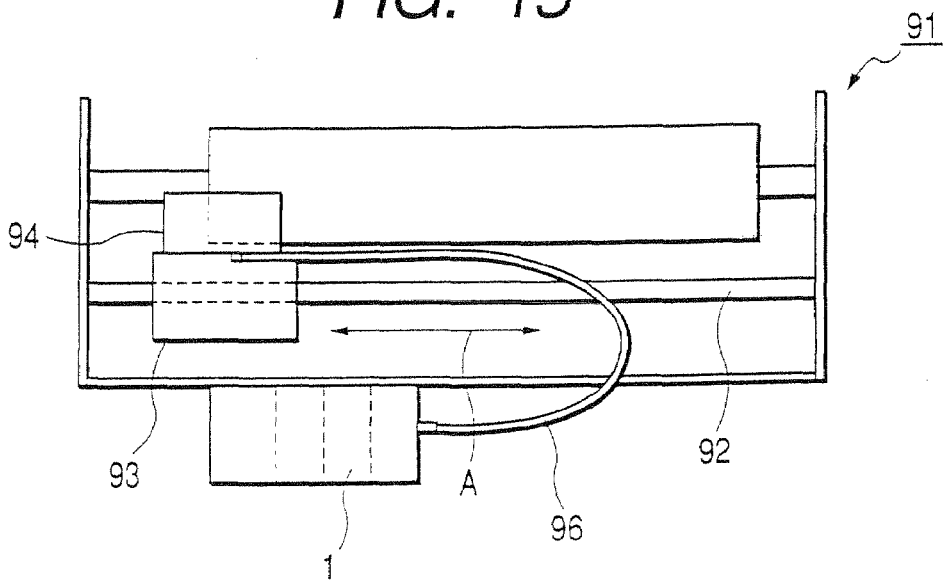
FIG. 15 is a schematic illustration of a major portion of an ink jet printer of the serial type into which the invention is incorporated.

FIG. 15 is a schematic illustration of a major portion of an ink jet printer of an first embodiment of the invention. The ink jet printer designated by reference numeral 91 is of the serial type. An ink jet head 94 is mounted on a carriage 93, which is reciprocatively movable along a guide shaft 92. Ink is supplied to the ink jet head 94 from an ink tank 1 attached onto a tank attaching part (not shown) by way of a flexible ink tube 96.

Figure 1A:
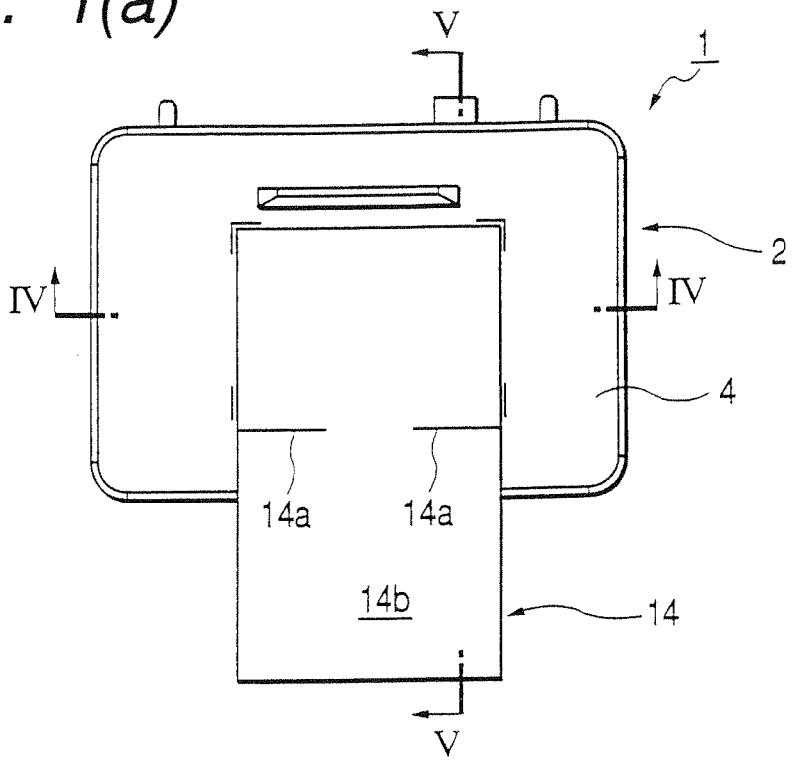
FIGS. 1(*a*) and 1(*b*) are a plan view and a front view showing the ink tank of the foam type which is an embodiment of the invention.
Figure 1B:
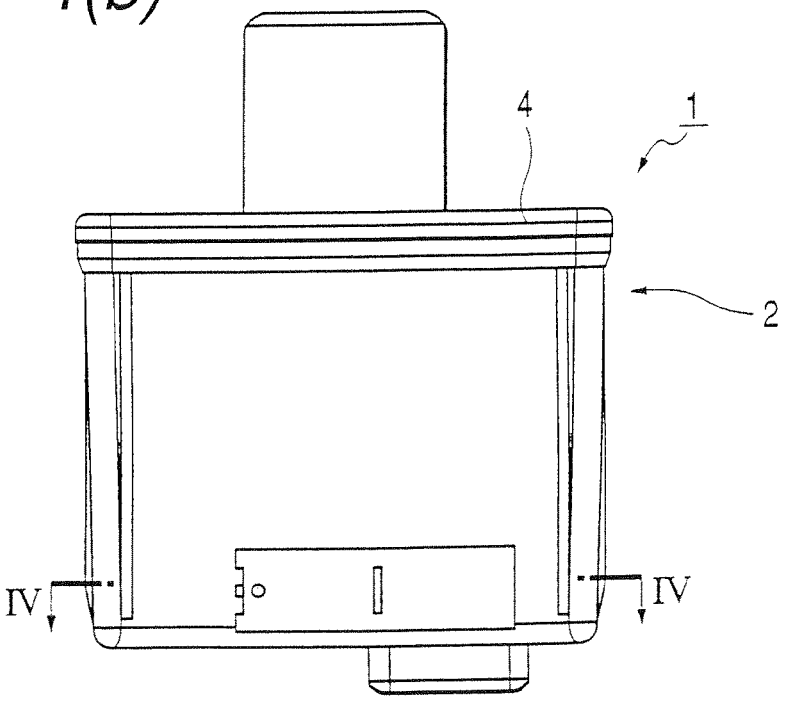
Figure 2:
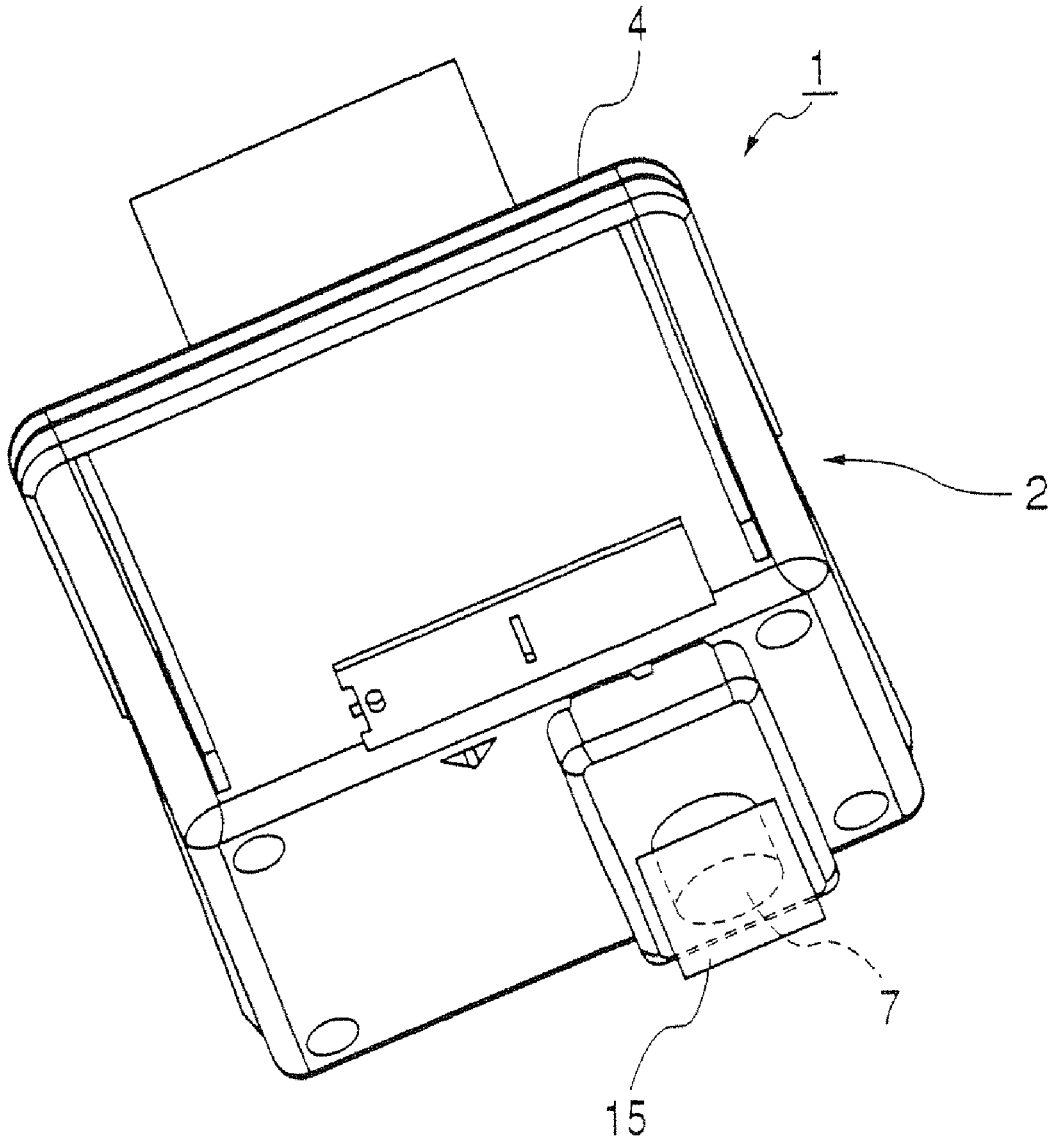
FIG. 2 is a perspective view showing the ink tank of FIG. 1 when viewed from the bottom thereof.
Figure 3:
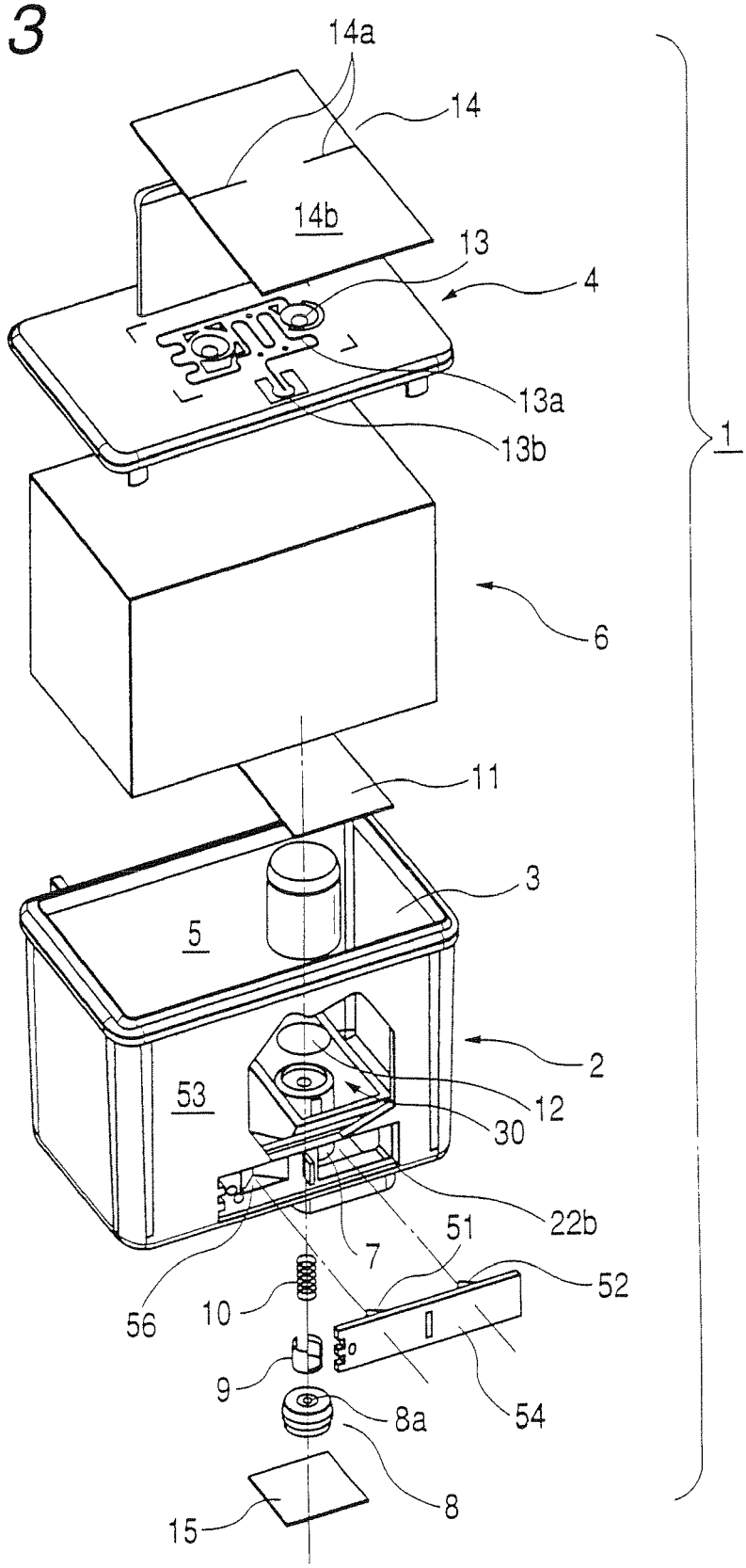
FIG. 3 is an exploded perspective view showing the ink tank of FIG. 1.

FIGS. 1(*a*) and 1(*b*) are a plan view and a front view showing the ink tank which is an embodiment of the invention. FIG. 2 is a perspective view showing the ink tank when viewed from the bottom thereof. FIG. 3 is an exploded perspective view showing the ink tank.

In use, the instant ink tank 1 is detachably attached to a tank attaching part of the ink jet printer 91. The ink tank 1 includes a rectangular container body 2 of which the top side is opened, and a container lid 4 sealing the top-side opening 3. A main ink chamber 5 is formed in a space defined by those, and contains a foam 6 (ink absorbing member), which is rectangular as a whole in shape, and absorptively retains ink therein.

An ink outlet 7 is formed in the bottom surface of the container body 2. A disc-like rubber packing 8 is fit to the ink outlet 7, and a through hole 8*a* is formed at and through the central part of the rubber packing and serves as an ink drawing-out port. A valve 9 capable of sealing the through hole 8*a* is located at a position deeper than the rubber packing 8 of the ink outlet 7. The valve 9 is constantly pressed against the rubber packing 8 by a coiled spring 10 to seal the through hole 8*a*.

The main ink chamber 5 communicates with the ink outlet 7 via a sub ink chamber 30, which is defined by first and second filters 11 and 12, and is opened to the air through an air communicating hole 13 formed in the container lid 4. Accordingly, when the ink absorptively retained in the foam 6 set in the main ink chamber 5 is sucked out through the ink outlet 7, an amount of air corresponding to an amount of ink sucked enters the main ink chamber 5 through the air communicating hole 13.

The air communicating hole 13 of the container lid 4 connects to a bent groove 13*a* formed in the surface of the container lid 4, and an end 13*b* of the bent groove 13*a* extends to a position near the edge end of the container lid 4. At the time of manufacturing of the ink tank 1, a seal 14 may be stuck to a portion of the container lid 4 at which the air communicating hole 13 and the bent groove 13*a* may be formed. In use, a part 14*b* of the seal 14 is peeled off along a cut line 14*a* of the seal 14, and then the end 13*b* of the bent groove 13*a* is exposed and the air communicating hole 13 is opened to the air.

The ink outlet 7 in the container bottom surface is also stuck with a seal 15. When the ink tank 1 is attached to the tank attaching part, a ink supplying needle 65 (see FIG. 4(*b*) attached to the tank attaching part breaks through the seal 15 and enters the through hole 8*a*. As a result, the ink tank 1 is put in an attaching or loading state.

Figure 4A:
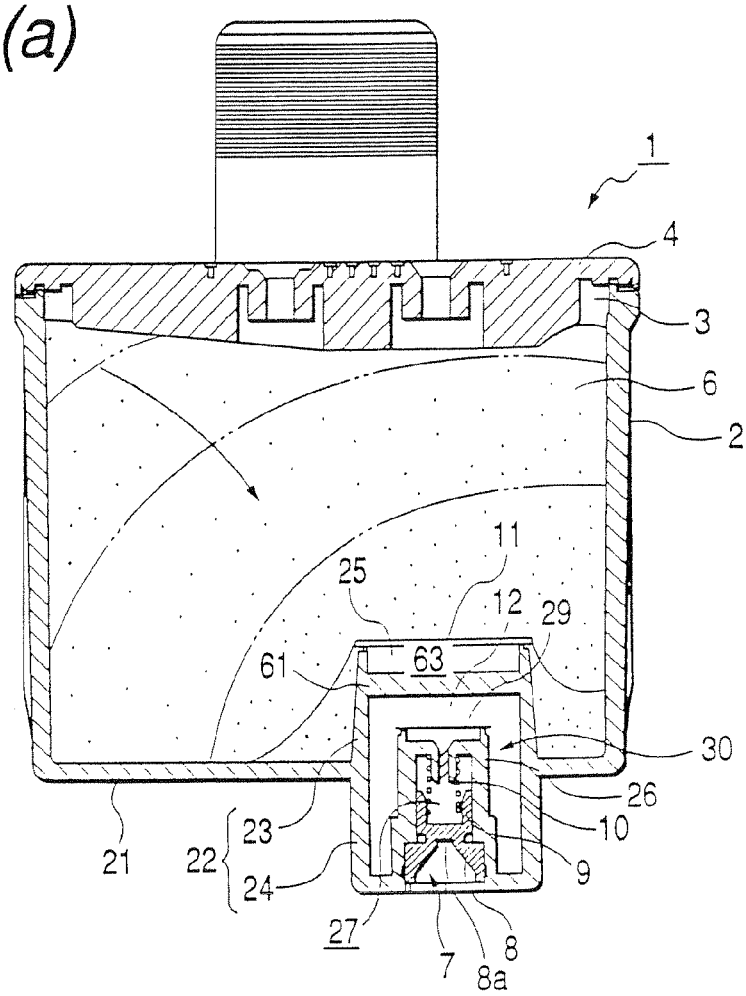
FIG. 4(*a*) is a cross sectional view showing the ink tank 1 when taken on line IV-IV in FIG. 1, and 4(*b*) is an enlarged view showing a part of the ink tank when the tank is attached.
Figure 4B:
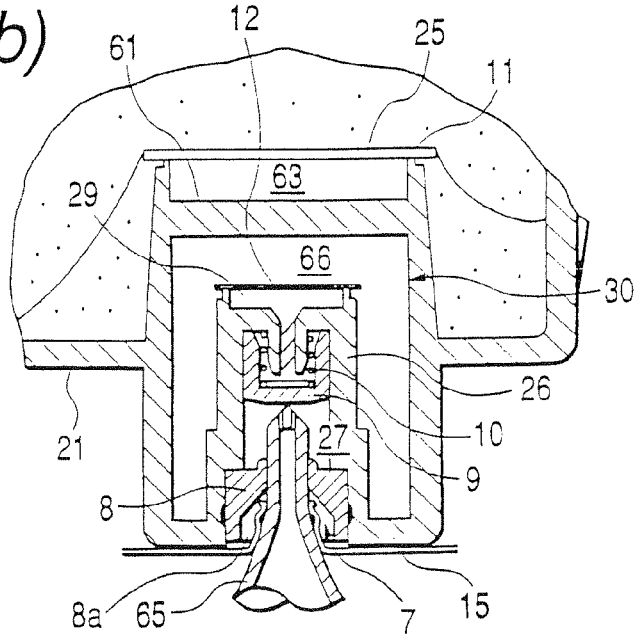

FIG. 4(*a*) is a cross sectional view showing the ink tank 1 when taken on line IV-IV in FIG. 1, and 4(*b*) is an enlarged view showing a part of the ink tank when the tank is attached.

Figure 5:
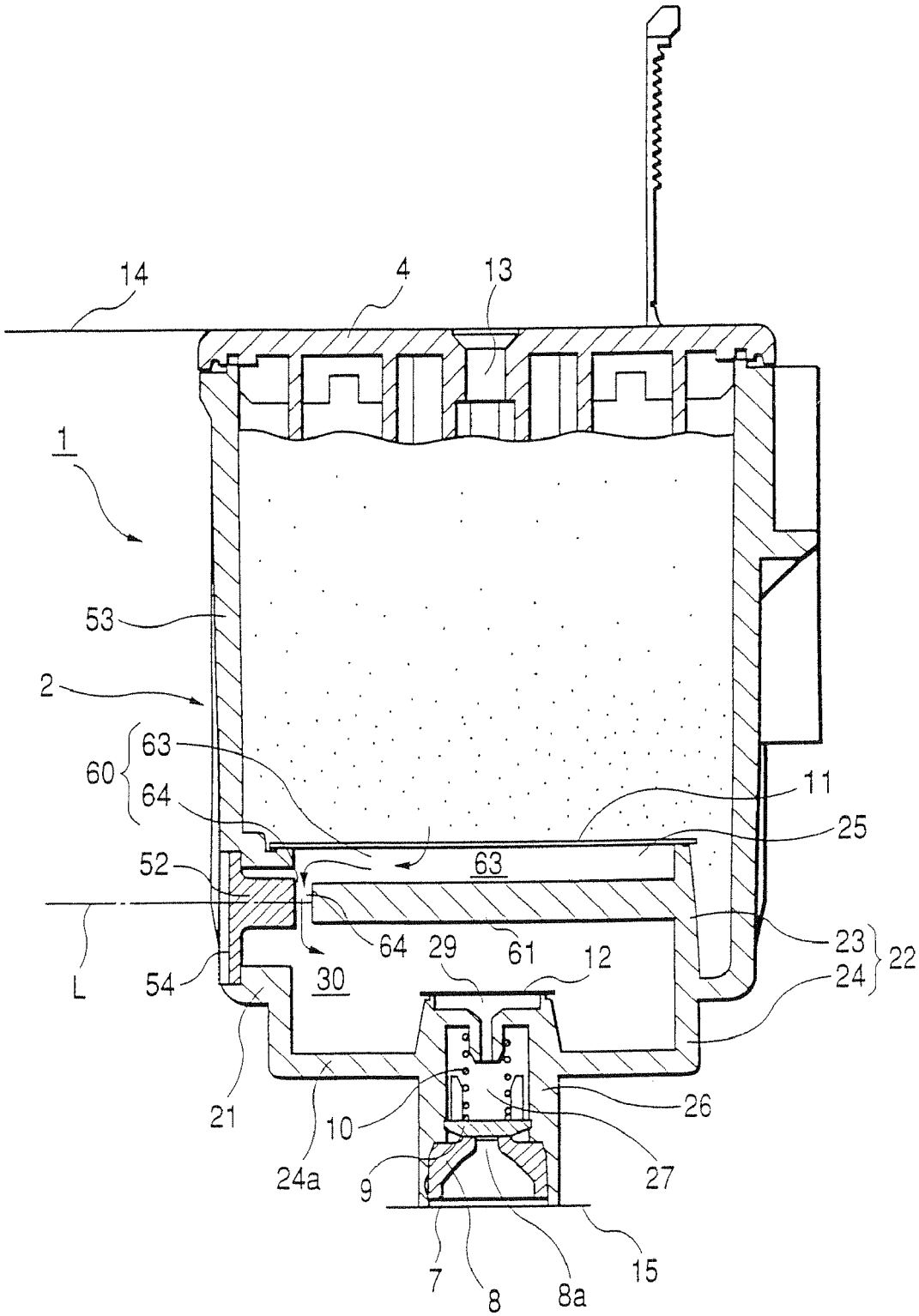
FIG. 5 is a cross sectional view showing the ink tank 1 when taken on line V-V in FIG. 1.
Figure 6:
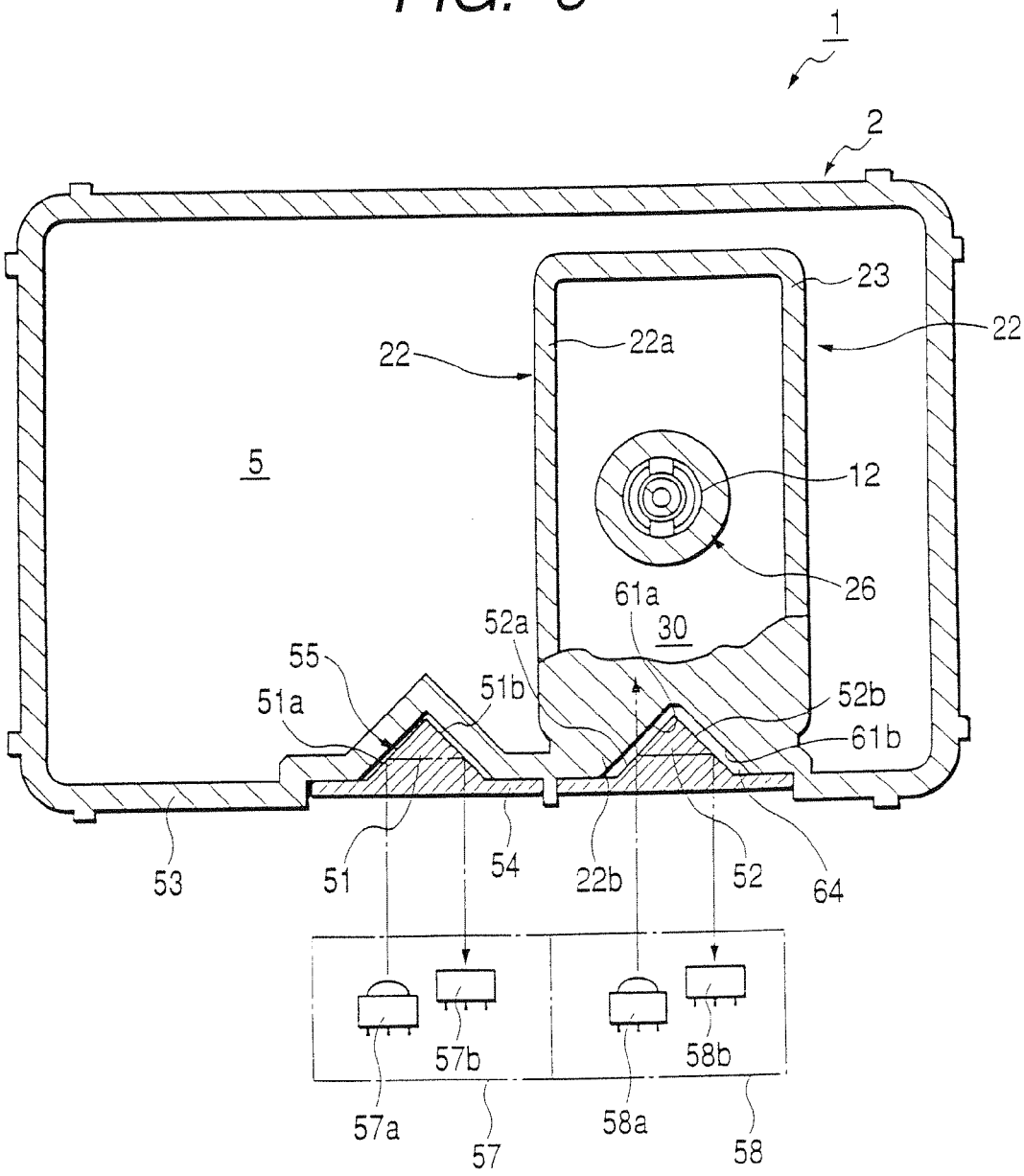
FIG. 6 is a cross sectional view showing the ink tank 1 when taken on line VI-VI in FIG. 1.

FIG. 5 is a cross sectional view showing the ink tank 1 when taken on line V-V in FIG. 1. FIG. 6 is a cross sectional view showing the ink tank 1 when taken on line VI-VI in FIG. 1.

As shown in those figures, the sub ink chamber 30 defined by the first and second filters 11 and 12 is formed between the ink outlet 7 and the main ink chamber 5. A cylindrical frame 22, rectangular in cross section, is provided in the bottom plate part 21 of the container body 2 in a state that it passes through the bottom plate part 21 and vertically extends. A rectangular communication port 25 (main ink chamber side communication port) is formed in the upper end of an upper cylindrical frame part 23 of the cylindrical frame 22, which stands upright in the main ink chamber 5. The first filter 11, rectangular in shape, is mounted on the communication port 25.

A lower end opening of a lower cylindrical frame part 24, which projects vertically and downward from the bottom plate part 21 of the cylindrical frame 22, is sealed with a frame bottom plate part 24*a* which is integrally formed therewith. A protruded part 26, cylindrical as a whole in shape, extends upward and downward from the central part of the frame bottom plate part 24*a* in the vertical direction. A center hole of the cylindrical protruded part 26 serves as an ink passage 27 communicating with the ink outlet 7. The rubber packing 8, the valve 9 and the coiled spring 10 are assembled into this part. A spring receiving part 28 for receiving the coiled spring 10 is integrally formed on the inner peripheral surface of the cylindrical protruded part 26. The second filter 12 is mounted on a circular communication port 29 (ink outlet side communication port), which is formed in the upper end of the cylindrical protruded part 26.

The first filter 11 of the instant embodiment permits ink to pass therethrough, and is made of a porous material which permits air bubbles to pass therethrough under an ink suction force acting on the ink outlet 7. In other words, the first filter is made of a porous material having such a fine hole size as to provide a capillary attraction at which the ink meniscus is broken by the ink absorbing force. This first filter 11 is formed of unwoven fabric, mesh filter or the like.

The second filter 12 is made of a porous material having fine holes which are each smaller in diameter than those of the first filter 11. Accordingly, ink may be prevented from passing through the second filter 12 except for when an ink pump (not shown) is sucked and an ink suction force acts on the ink outlet. The fine hole of the second filter 12 is sized so as to capture foreign materials contained in the ink. The second filter 12 may also be formed of unwoven fabric, mesh filter or the like.

Here, the "ink suction force" is an ink suction force which acts on the ink outlet 7 responsively to an ink ejection pressure in the ink jet head 94 as an object to which ink is to be supplied or a suction force by the ink pump.

A detected portion is disposed on the ink tank 1 of the instant embodiment. The detected portion optically detects if the ink tank 1 is attached to the tank attaching part of the ink jet printer 91, and detects an ink end of the ink tank 1. The detected portion includes a right-angled prism 51 for detecting if the ink tank 1 is attached to the tank attaching part of the ink jet printer 91, another right-angled prism 52 for optically detecting that an amount of ink left in the sub ink chamber 30 is below a predetermined amount of ink or ink liquid level, and an ink passage 64 for guiding air bubbles, which have entered the sub ink chamber 30 via the first filter 11, to the reverse surfaces (ink interface) of reflecting surfaces 52*a* and 52*b* of the right-angled prism 52.

Referring to FIGS. 3, 4, 5, and 6, a laterally extending, rectangular plate 54 is secured to a lower end part of a side plate of the container body 2. The right-angled prisms 51 and 52 are integrally formed on the inner surface of the rectangular plate 54, while being separated from each other by a fixed distance. The right-angled prisms 51 and 52 each include a couple of reflecting surfaces 51*a* and 51*b* and 52*a* and 52*b*, respectively, which are arranged at a right angle.

The right-angled prism 51 is confronted with a side plate 53 of the container body 2, with an air layer 55 of a fixed gap being disposed between them. A recess 56, having a shape corresponding to a shape of the right-angled prism 51, is formed in the side plate 53. With provision of the recess 56, the reflecting surfaces 51*a* and 51*b* are confronted with the side plate 53 of the main ink chamber 5 with the air layer 55 of the fixed gap. The right-angled prism 52 is directly exposed into the interior of the sub ink chamber 30 through an opening 22*b*, which is formed in the cylindrical frame 22 defining the sub ink chamber 30. The reverse surfaces of the reflecting surfaces 52*a* and 52*b* serve as ink interfaces.

A partitioning part 61 is disposed within the sub ink chamber 30, and partitions the interior of the sub ink chamber 30 into a bubble storage part 63 (first sub ink chamber) closer to the first filter 11 and an ink storage part 66 (second sub ink chamber) of the lower part, which is closer to the second filter 12. The partitioning part 61 and the right-angled prism 52 form the ink passage 64. The partitioning part 61 is disposed at a height level with the reflecting surfaces 52*a* and 52*b* of the right-angled prism 52 in the interior of the sub ink chamber 30, thereby forming the ink passage 64 for leading ink and air bubbles having entered the bubble storage part 63 to the reverse surfaces of the reflecting surfaces 52*a* and 52*b* of the right-angled prism 52. To be more specific, facing or opposite surfaces 61*a* and 61*b* are formed on the partitioning part 61, and confronted respectively with the reflecting surfaces 52*a* and 52*b* of the right-angled prism 52 with gaps being interposed between them. The ink passage 64, continuous to the bubble storage part 63, is formed by the reverse surfaces of the reflecting surfaces 52*a* and 52*b* and the opposite surfaces 61*a* and 61*b*. Accordingly, when an ink liquid level of the sub ink chamber 30 is above the mounting position of the right-angled prism 52, the reflecting surface 52*b* is in contact with the ink. In this condition, the reflecting surfaces do not function as reflecting surfaces. When the ink liquid level lowers to below the mounting position, the reflecting surfaces 52*a* and 52*b* function as the reflecting surfaces.

A width of the ink passage 64 where the reverse surfaces of the reflecting surfaces 52*a* and 52*b* of the right-angled prism 52 serve as the ink interfaces is selected to be narrower than a diameter of an air bubble generated by air which has entered the sub ink chamber 30 via the first filter 11, for example, 0.2 to 0.5 mm.

As shown in FIG. 6, optical sensors 57 and 58 of the reflection type are mounted on the ink jet printer 91 to which the ink tank 1 is attached. The optical sensor 57 includes a light emitting element 57*a* and a light receiving element 57*b*, and the optical sensor 58 includes a light emitting element 58*a* and a light receiving element 58*b*. The optical sensor 57 is arranged such that light emitted from the light emitting element 57*a* is incident on the reflecting surface 51*a* at a 45° angle, and light reflected by the reflecting surfaces 51*a* and 51*b* is received by the light receiving element 57*b*. The optical sensor 58 is arranged such that light emitted from the light emitting element 58*a* is incident on the reflecting surface 52*a* at a 45° angle, and light reflected by the reflecting surfaces 52*a* and 52*b* is received by the light receiving element 58*b*.

Detecting Operation

Detection as to if the ink tank 1 is attached to the tank attaching part of the ink jet printer 91 and detection of an ink end of the ink tank 1 are carried out in the following way.

When the ink tank 1 is attached to the tank attaching part of the ink jet printer 91, as shown in FIG. 4(*b*), the tip of the ink supplying needle 65 provided on the ink jet printer 91 passes through the through hole 8*a* of the rubber packing 8 set to the ink outlet 7 of the ink tank 1, and pushes upward the valve 9 located within the ink passage 27.

As a result, the ink outlet 7 is put in an opened state. Ink absorptively retained in the foam 6 in the main ink chamber 5 of the ink tank 1 flows into the ink passage 27 via the first filter 11 and the sub ink chamber 30, and passes through the ink supplying needle 65, and may be supplied to the ink jet head 94 of the ink jet printer 91. The remaining features of such an ink supplying mechanism are known, and hence, no further description will be given.

When the ink tank 1 is thus attached, the right-angled prism 51 formed on the side surface thereof is confronted with the optical sensor 57 of the ink jet printer 91 side. Light emitted from the optical sensor 57 is reflected by the reflecting surfaces 51*a* and 51*b* of the right-angled prism 51 and received by the optical sensor 57. In this way, the fact that attachment of the ink tank 1 has been made is detected.

When the ink jet head 94 is driven and ink ejection is performed, an ink suction force acts on the ink outlet 7 in response to the ink ejection force, and ink is supplied to the ink jet head 94. When the ink is supplied and ink retained in the foam 6 decreases, then air flows into the main ink chamber 5 via the air communicating hole 13. As indicated by two-dot chain lines in FIG. 4(*a*), an amount of ink contained in the foam 6 gradually decreases, while at the same time air enters the foam 6. When an amount of ink left in the foam 6 decreases to be small, part of the air passes, in the form of air bubbles, through the first filter 11 and enters the sub ink chamber 30. Accordingly, the air bubbles are gradually collected in the bubble storage part 63 of the sub ink chamber 30.

When the residual ink is further supplied, an ink liquid level in the ink passage 64 gradually decreases and the couple of reflecting surfaces 52*a* and 52*b* of the right-angled prism 52 gradually appear on the ink liquid surface. As a result, the couple of reflecting surfaces 52*a* and 52*b* begin to function as the reflecting surfaces. When the ink liquid level of the sub ink chamber 30 lowers to below a predetermined liquid level (e.g., a position L in FIG. 5), an amount of light received by the light receiving element 58*b* of the optical sensor 58 exceeds a predetermined amount of receiving light. The fact that the ink is used up (ink end) in the ink tank 1 is detected based on the increase of the receiving light amount of the light receiving element 58*b*.

If the volume of the sub ink chamber 30 is selected to be sufficiently small, the ink end is detected at a time point that the ink amount becomes extremely small. The ink end is detected in a state that the amount of residual ink is extremely small. As such, useless consumption of ink is restricted. Useless consumption of ink is further reduced if the ink end detected by the reflecting surfaces 52*a* and 52*b* is deemed as a near end, and the following process is carried out. After an ink near end is detected by the optical sensor 58, an amount of ink to be subsequently used is counted, and when the counted ink amount reaches an ink amount equal to the amount of ink stored in the sub ink chamber 30, a real end of ink is established. By so doing, ink can be used until the residual ink amount becomes substantially zero. The ink in the sub ink chamber 30 will further be described in detail.

The air bubbles having flowed from the main ink chamber 5 into the sub ink chamber 30 via the first filter 11, are guided to the reflecting surfaces 52*a* and 52*b* along the bubble storage part 63 defined by the partitioning part 61.

A width of the ink passage 64 is narrower than a diameter of an air bubble generated from the air having reached the interior of the sub ink chamber via the first filter 11. Accordingly, air bubbles gradually stagnate at a position near the upper end of the ink passage 64. When the amount of residual ink decreases and an ink liquid level in the ink storage part gradually decreases from the upper end position of the ink passage 64, the air bubbles are led to the reflecting surfaces 52*a* and 52*b*. As mentioned, the width of the ink passage 64 defined by the reflecting surfaces 52*a* and 52*b* is narrower than the diameter of an air bubble passing therethrough. The air bubbles having superseded the ink are put to a state as crushed, and pressed against the reflecting surfaces 52*a* and 52*b* and are put to a state of surface contact with the latter. As a result, such an unwanted situation that even if the ink liquid level lowers, the reflecting surfaces 52*a* and 52*b* are covered with ink retained in the spaces among the air bubbles, and those reflecting surfaces do not function as the reflecting surfaces, can surely be prevented. Therefore, a reliable ink end detection is secured.

As described above, in the ink tank 1 of the instant embodiment, the bubble storage part 63 and the ink passage 64 are formed within the sub ink chamber 30. The ink and air bubbles having flowed from the main ink chamber 5 into the sub ink chamber 30 are led onto the reflecting surfaces 52*a* and 52*b* of the right-angled prism 52 by the bubble storage part 63, and are made to flow via the ink passage 64 defined by the reflecting surfaces 52*a* and 52*b*.

Accordingly, the air bubbles having entered the sub ink chamber 30 are surely led onto the reflecting surfaces 52*a* and 52*b*. Further, at the ink passage of the reflecting surfaces, the ink liquid level surely lowers with decrease of the amount of residual ink. Accordingly, a sure ink end detection can be determined.

The interior of the sub ink chamber 30 is separated into the bubble storage part 63 and the ink storage part 66 by the partitioning part 61. Those separated parts communicate with each other by way of only the ink passage 64. With this structure, the partitioning part 61 reliably blocks the supplying of ink necessary for generating air bubbles from the ink storage part 66 to the bubble storage part 63. Accordingly, the generation of air bubbles is prevented and the ink end is precisely detected.

Figure 16A:
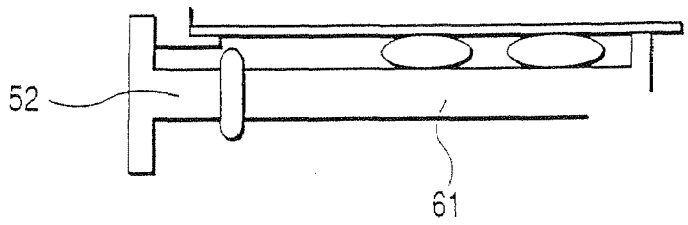
FIG. 16(*a*) is a cross sectional view showing the air bubbles, having flowed into the ink passage, crushed and pressed against the reflecting surfaces.
Figure 16B:
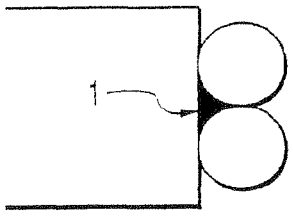

A width of the ink passage 64 defined by the reflecting surfaces 52*a* and 52*b* is selected to be narrower than a diameter of an air bubble generated within the sub ink chamber 30. Accordingly, as shown in FIG. 16(*a*), the air bubbles, having flowed into the ink passage 64, are crushed and pressed against the reflecting surfaces 52*a* and 52*b* in a surface contact state. As a result, as shown in FIG. 16 (*b*), there is no occurrence of such an unwanted situation that even if the ink liquid level lowers, the reflecting surfaces 52*a* and 52*b* remain covered with ink retained in the spaces among the air bubbles, and the ink end detection is impossible.

Second Embodiment

Figure 7:
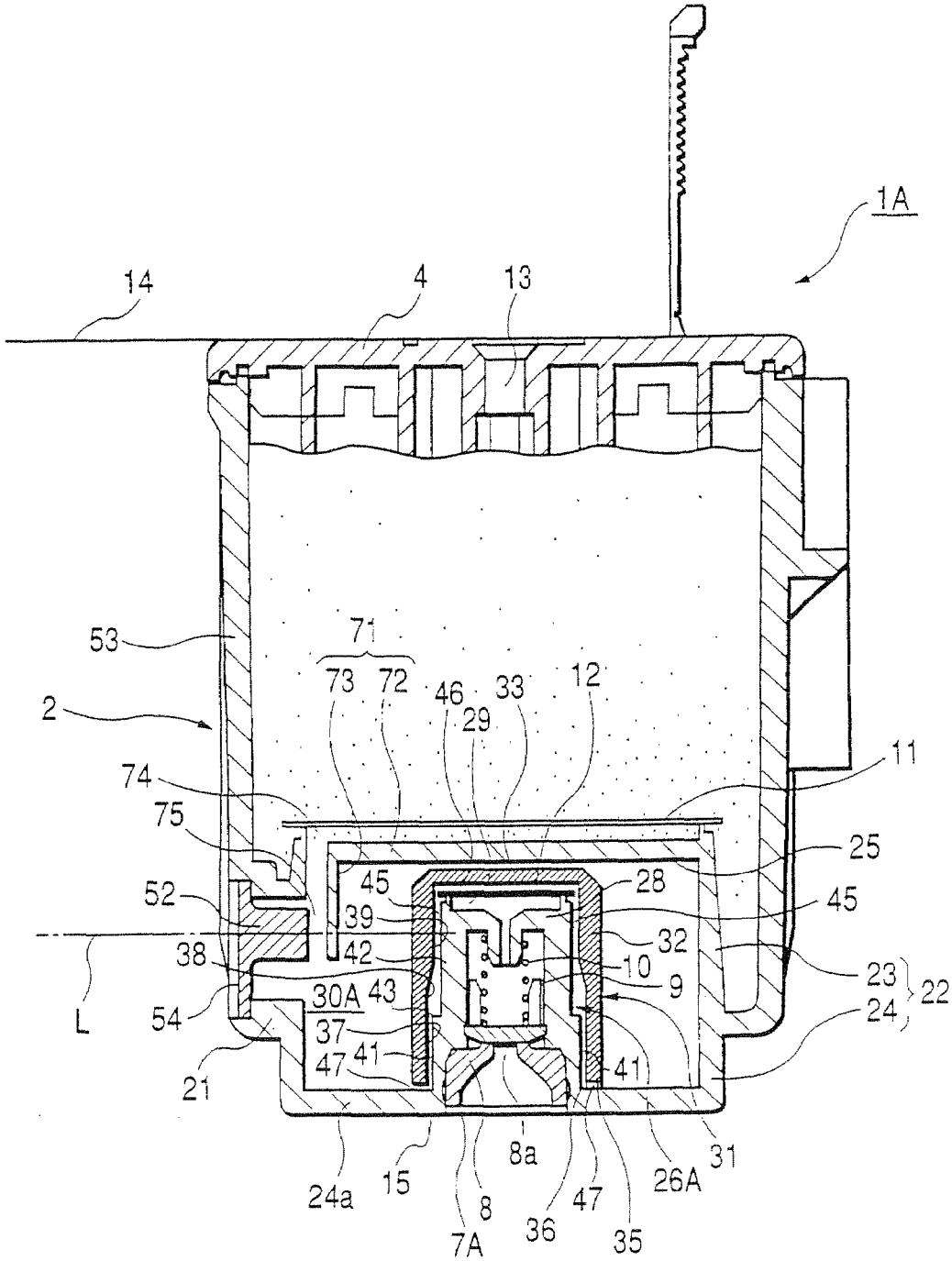
FIG. 7 is a view showing an ink tank according to a second embodiment of the invention, specifically a cross sectional view taken on line V-V in FIG. 1.
Figure 8:
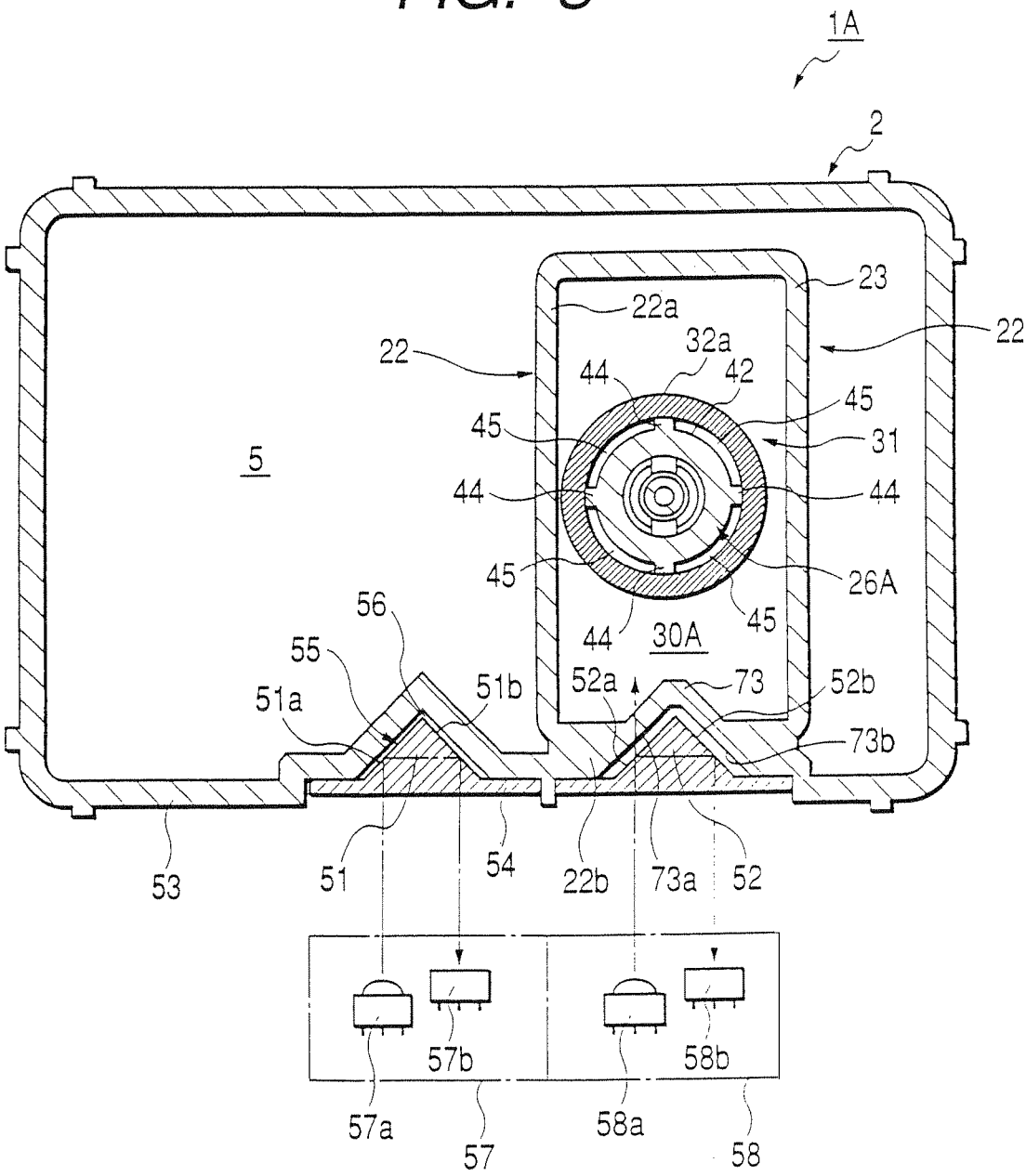
FIG. 8 is a view showing an ink tank according to a second embodiment of the invention, specifically a cross sectional view taken on line VI-VI in FIG. 1.

FIGS. 7 and 8 are cross sectional views showing major portions of an ink tank which is an second embodiment of the present invention. A basic construction of an ink tank 1A of the instant embodiment is substantially the same as of the ink tank 1 of the first embodiment except the construction including the sub ink chamber and the ink outlet. Accordingly, in FIGS. 7 and 8, like or equivalent portions will be designated by like reference numerals, and description will be given about only the different parts and portions. FIGS. 7 and 8 are cross sectional views taken on the same lines as those in FIGS. 5 and 6 showing the first embodiment. A structure of an ink passage which is formed between an ink outlet 7A and a main ink chamber 5 in the ink tank 1A will be described with reference to those figures. A cylindrical frame 22, rectangular in cross section, is provided in the bottom plate part 21 of the container body 2 in a state that it passes through the bottom plate part 21 and vertically extends. A rectangular communication port 25 is formed in the upper end of an upper cylindrical frame part 23 of the cylindrical frame 22, which stands upright in the main ink chamber 5. The first filter 11, rectangular in shape, is mounted on the communication port 25.

A lower end opening of a lower cylindrical frame part 24 which projects vertically and downward from the bottom plate part 21 of the cylindrical frame 22 is sealed with a frame bottom plate part 24*a* which is integrally formed therewith. A protruded part 26A, cylindrical as a whole in shape, extends upward from the central part of the frame bottom plate part 24*a* in the vertical directions. A center hole of the cylindrical protruded part 26A serves as an ink passage 27 communicating with the ink outlet 7A. The rubber packing 8, the valve 9 and the coiled spring 10 are assembled into this part. A spring receiving part 28 for receiving the coiled spring 10 is integrally formed on the inner peripheral surface of the cylindrical protruded part 26A.

The cylindrical protruded part 26A extends to a position, which is lower than the first filter 11 by a predetermined distance, and a second filter 12 is mounted on a circular communication port 29 formed at the upper end of the cylindrical protruded part. Accordingly, in the ink tank 1A of the instant embodiment, a sub ink chamber 30A is formed between the main ink chamber 5 and the ink outlet 7A.

A cup-like cap 31 for sucking ink is disposed in the sub ink chamber 30A of the instant embodiment. The air communicating hole 13 sucks up ink stored on the bottom of the sub ink chamber 30A to the circular communication port 29 to which the second filter 12 located in the upper part is mounted.

The cup-like cap 31 includes a cylindrical part 32 and a top plate 33 which sealingly covers the upper end of the cylindrical part. A plurality of protrusions are vertically protruded from a circular end face 35 of its lower end opening 34, while being equiangularly arranged. In the instant embodiment, four protrusions 36 having equal heights are angularly arranged at an angular interval of 90°. The inner circumferential wall of the cylindrical part 32 includes a lower surface all part 37, a tapered surface part 38 which is continuous to the upper side and radially protruded slightly inward, and an upper surface part 39 having a small diameter and extending upwardly from the upper end of the tapered inner wall part.

The cup-like cap 31 is applied, from above, to the cylindrical protruded part 26A formed within the sub ink chamber 30A, whereby the cylindrical protruded part is capped with the cup-like cap. The outer circumferential surface of the cylindrical protruded part 26A includes a large-diameter surface part 41 whose lower part is slightly large, a small-diameter surface part 42 extending upward from the large-diameter surface part, and a ring-like stepped part 43 located between them. As shown in FIG. 8, the small-diameter surface part 42 includes ribs 44 which are protruded outwardly thereof and angularly arranged at a predetermined angular interval. In the embodiment, four ribs 44 are angularly arranged at an angular interval of 90°. Those ribs 44 have equal protrusion quantities, and each of the ribs has a predetermined vertical length. The protrusion quantity of each rib 44 is selected so that those ribs are just fit into the upper surface part 39 of the cup-like cap 31.

When the cylindrical protruded part 26A is capped with the cup-like cap 31, the cup-like cap 31 is positioned by the four ribs 44 and four ink suction gaps 45, arcuate in cross section, are formed each between the inner circumferential surface of the cup-like cap 31 and the outer circumferential surface of the cylindrical protruded part 26A. A height ranging from the lower surfaces of the protrusions 36, which is formed on the circular end face 35 at the lower end of the cup-like cap 31, to the reverse surface of the top plate 33 is selected to be larger than the height of the cylindrical protruded part 26A. Accordingly, in the capping state, an ink passage gap 46 of a predetermined gap width is formed between the second filter 12 mounted on the upper end of the cylindrical protruded part 26A and the reverse surface of the top plate 33 of the cup-like cap 31. The ink passage gap 46 communicates with the ink suction gaps 45. Further, in the capping state, four gaps 47, arcuate in cross section, each having a fixed gap width, are formed among the four protrusions 36 formed at the lower end of the cup-like cap 31. The gaps 47, arcuate in cross section, communicate with the ink suction gaps 45 also arcuate in cross section.

If those gaps 45, 46 and 47 are designed to have appropriate gap widths, such an ink sucking path that ink is sucked up from the gaps 47, passes through the ink suction gaps 45, the second filter 12, and the circular communication port 29 at the upper end of the cylindrical protruded part 26A, is formed. With provision of the ink sucking path, even when the amount of ink stored in the sub ink chamber 30A decreases, and the ink liquid level lowers to below the second filter 12, the ink is sucked up from the sub ink chamber to the position of the second filter 12, and the ink may be supplied from the ink passage 27 to the ink outlet 7A. In the instant embodiment, the outer circumferential surface 32*a* of the cup-like cap 31 is separated from the inner side wall 22*a* of the cylindrical frame 22 defining the sub ink chamber 30A by a predetermined distance. In the embodiment, ink stored in the ink chamber can be efficiently sucked up by the cup-like cap 31. A rectangular plate 54 having the same right-angled prisms 51 and 52 as those in the first embodiment is fastened also to the ink tank 1A.

An ink passage 75 mounted on the right-angled prism 52 is defined by a partitioning part 71, bent like L as a whole. The partitioning part 71 includes a flat part 72 which is separated from the first filter 11 by a fixed distance and while being arrayed parallel to the latter, and a bent part 73 which is bent at a right angle at the end of the flat part 72 closer to the right-angled prism 52. The interior of the sub ink chamber 30A is divided, by the flat part 72, into two sections, and a bubble storage part 74 is formed between the flat part 72 and the first filter 11.

A lower half part of the bent part 73 of the partitioning part 71 includes a pair of opposite surfaces 73*a* and 73*b*, which are confronted with the reverse surfaces of the reflecting surfaces 52*a* and 52*b* of the right-angled prism 52 with a fixed gap being interposed therebetween. Those couples of reflecting surfaces 52*a* and 52*b*, and 73*a* and 73*b* define the ink passage 75, narrow in width, which is continuous to the bubble storage part 74.

A space of the ink passage 75 is narrower than the bubble storage part 74, and is dimensioned within 0.2 to 0.5 mm which is narrower than a diameter of an air bubble formed in the sub ink chamber 30A. Accordingly, the air bubbles, having flowed into the ink passage 75, are crushed and pressed against the reflecting surfaces 52*a* and 52*b* defining the ink passage 75 in a surface contact state.

The thus constructed ink tank 1A of the instant embodiment produces advantages comparable with those of the ink tank 1. Specifically, in the instant embodiment, the partitioning part 71 is disposed within the sub ink chamber 30A, and guides ink and air bubbles having flowed from the main ink chamber 5 to the sub ink chamber 30A to the reflecting surfaces 52*a* and 52*b* of the right-angled prism 52, and the air and air bubbles flow through the ink passage 75 defined by the reflecting surfaces 52*a* and 52*b*.

Accordingly, the air bubbles, having flowed into the sub ink chamber 30A, are surely led to the reflecting surfaces 52*a* and 52*b* of the prisms. Hence, at the ink passage of the prism reflecting surfaces, the ink liquid level surely lowers with decrease of the amount of residual ink, and sure detection of the ink end is secured.

A space of the ink passage 75 defined by the reflecting surfaces 52*a* and 52*b* is dimensioned to be narrower than a diameter of an air bubble formed in the sub ink chamber 30A. Accordingly, the air bubbles having flowed into the ink passage 75 are crushed and pressed against the reflecting surfaces 52*a* and 52*b* in a surface contact state. As a result, such an unwanted situation that even if the ink liquid level lowers, the reflecting surfaces 52*a* and 52*b* remain covered with ink retained in the spaces among the air bubbles, and it is impossible to detect the ink end, is avoided.

Further, the ink passage 27 communicating with the ink outlet 7 is protruded into the sub ink chamber 30A. With this feature, the ink end detection construction containing them is made compact, so that an increase of the ink tank installing space may be reduced. A valve 9 and a coiled spring 10, which sealingly close the ink outlet 7, and others are disposed in the ink passage 27, so that the ink outlet is made compact.

In addition, the instant embodiment includes an ink suction mechanism for sucking up ink stored on the bottom part of the sub ink chamber 30A to the position of the second filter 12 by means of the cup-like cap 31. Accordingly, when a real end of ink is detected by counting the amount of ink used from the detection of an ink near end by the optical sensor 58, ink stored in the sub ink chamber 30A is substantially completely sucked and supplied from the ink outlet 7 to the ink jet head 94. And, a real end state of ink can be detected at a time point that the ink becomes substantially zero in the sub ink chamber 30A, and a detection accuracy of detecting the real end is increased.

The instant embodiment is provided with the second filter 12. If the cup-like cap 31 is used, the second filter 12 may be omitted.

Figure 9:
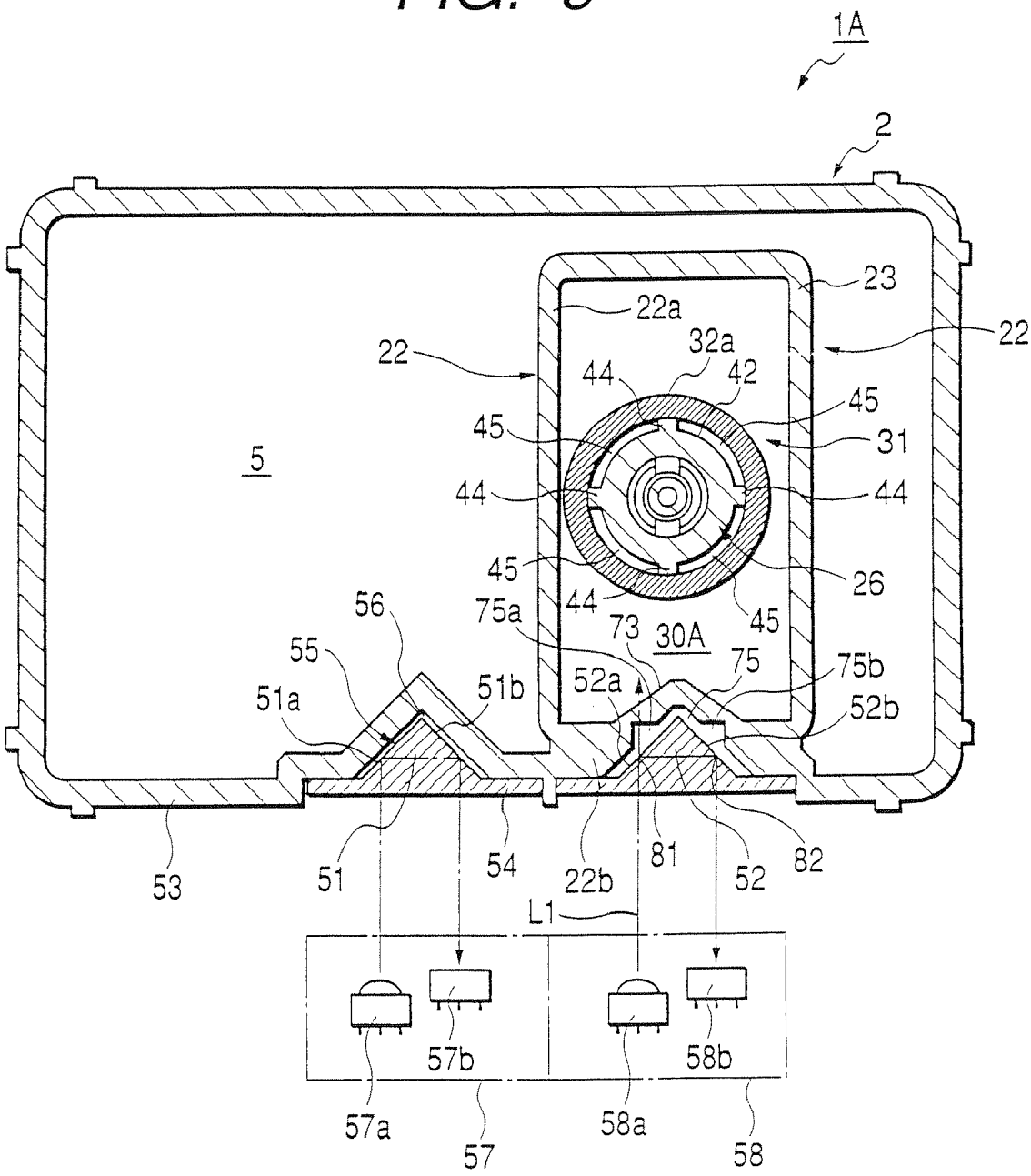
FIG. 9 is a cross sectional view showing another example of the ink passage shown in FIG. 8.

In the embodiments 1 and 2, the ink passage 64 (75) of which the width is fixed and narrow is provided between the reflecting surfaces 52*a* and 52*b* of the right-angled prism 52 and the opposite surfaces 61*a* and 61*b* or 73*a* and 73*b*. The ink passage may be formed in the following way. This will be described by using the construction of the second embodiment, by way of example. As shown in FIG. 9, the ink passage 75 formed on the reverse surfaces of the couple of reflecting surfaces 52*a* and 52*b* of the right-angled prism 52 is fixed in width as a whole. However, a part 75*a* of a given width of the ink passage which includes an incident position 81 of detecting light L1 on the reflecting surface 52*a* and a part 75*b* of a given width of the ink passage which includes a reflecting position 82 of the detecting light L1 on the other reflecting surface 52*b* are wider than that of the remaining part of the ink passage.

When the spaces of those parts of the ink passage corresponding to the incident and reflecting positions of the detecting light L1 are selected to be wide, the air bubbles easily flow through the ink passage parts 75*a* and 75*b*. Therefore, the air bubbles surely pass through the ink passage parts 75*a* and 75*b* corresponding to the incident and reflecting positions of the detecting light L1, so that sure ink end detection is secured.

Figure 10:
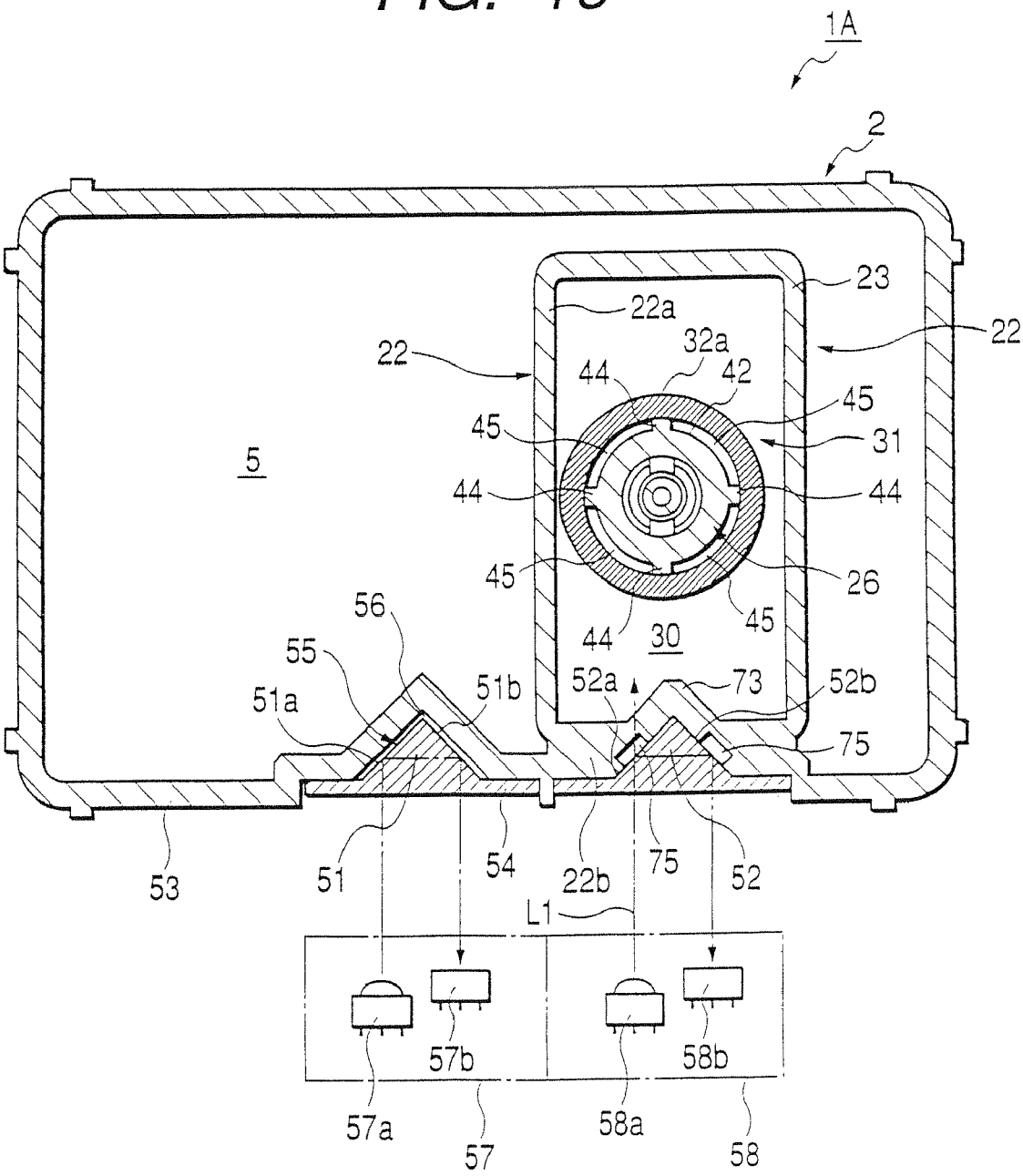
FIG. 10 is a cross sectional view showing yet another example of the ink passage shown in FIG. 8.

In an instance of FIG. 10, the ink passage parts 75 are formed only at the ink passage parts of the given widths including the incident position 81 and the reflecting position 82 of the detecting light L1. If so constructed, the air bubbles surely pass the incident and reflecting positions of the detecting light L1. As such, a reliable detection of the ink end state is ensured.

Figure 11:
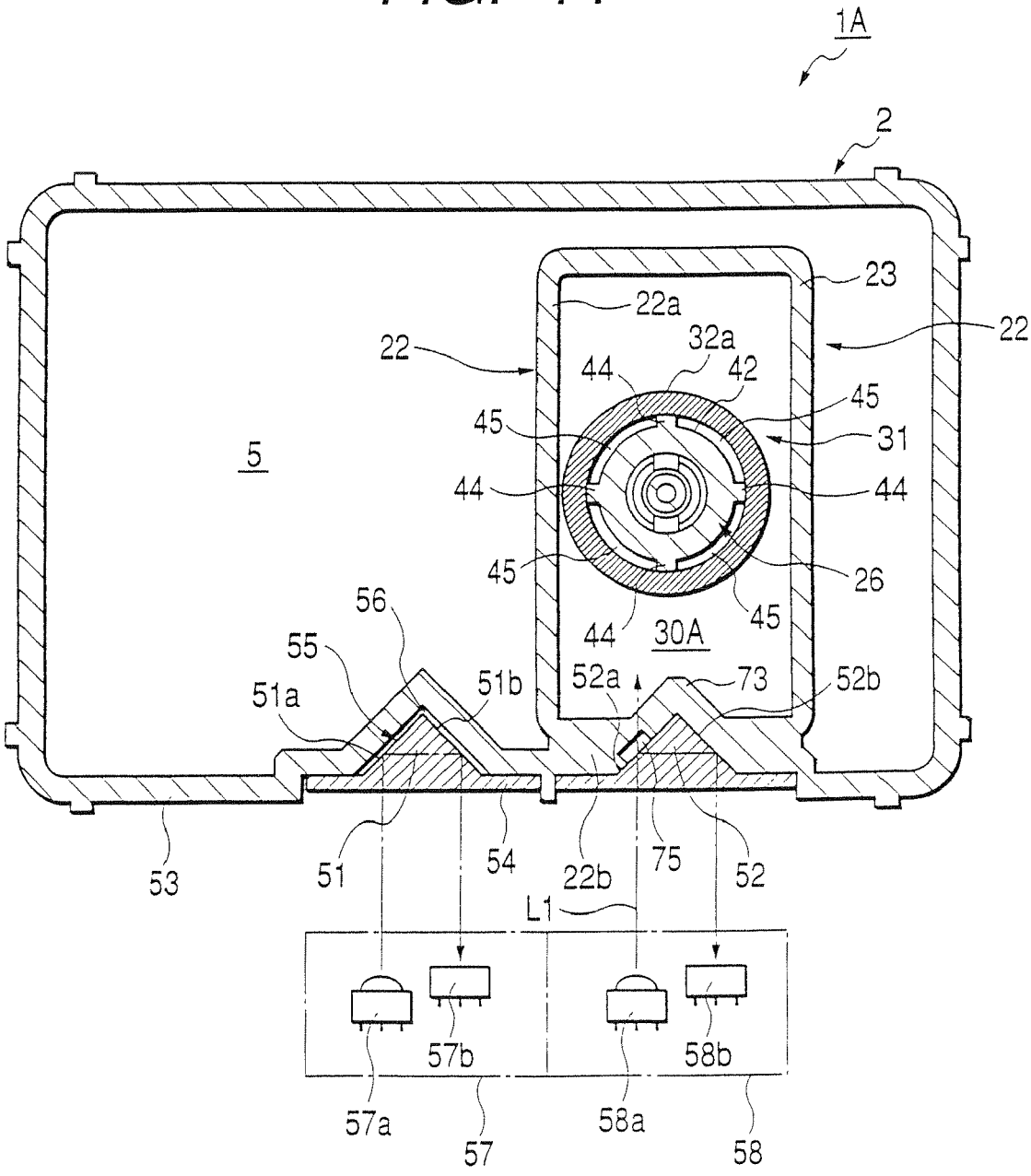
FIG. 11 is a cross sectional view showing still another example of the ink passage shown in FIG. 8.

To make the structure of the parts of the ink passage 75 simpler, as shown in FIG. 11, the ink passage 75 is formed at only the part of the given width including the incident position 81 of the detecting light L1. Instead of this, the ink passage 75 may be formed at only the part of the given width including the reflecting position 82 of the detecting light L1. Also in those cases, the ink end can be detected surely and accurately.

Third Embodiment

In the first and second embodiments, the partitioning part 61 (71) is formed integrally with the container body 2. The partitioning part may be a separated part, if required. In the third embodiment, a partitioning part 71 is formed integrally with a cup-like cap 31A of the second embodiment. This will be described with reference to FIGS. 12 through 14. A basic construction of an ink tank 1B of the instant embodiment is the same as each of the ink tanks 1 and 1A in the embodiments 1 and 2, except a partitioning member. In those figures, like or equivalent portions are designated by like reference numerals. Description will be given about only the different portions.

Figure 12:
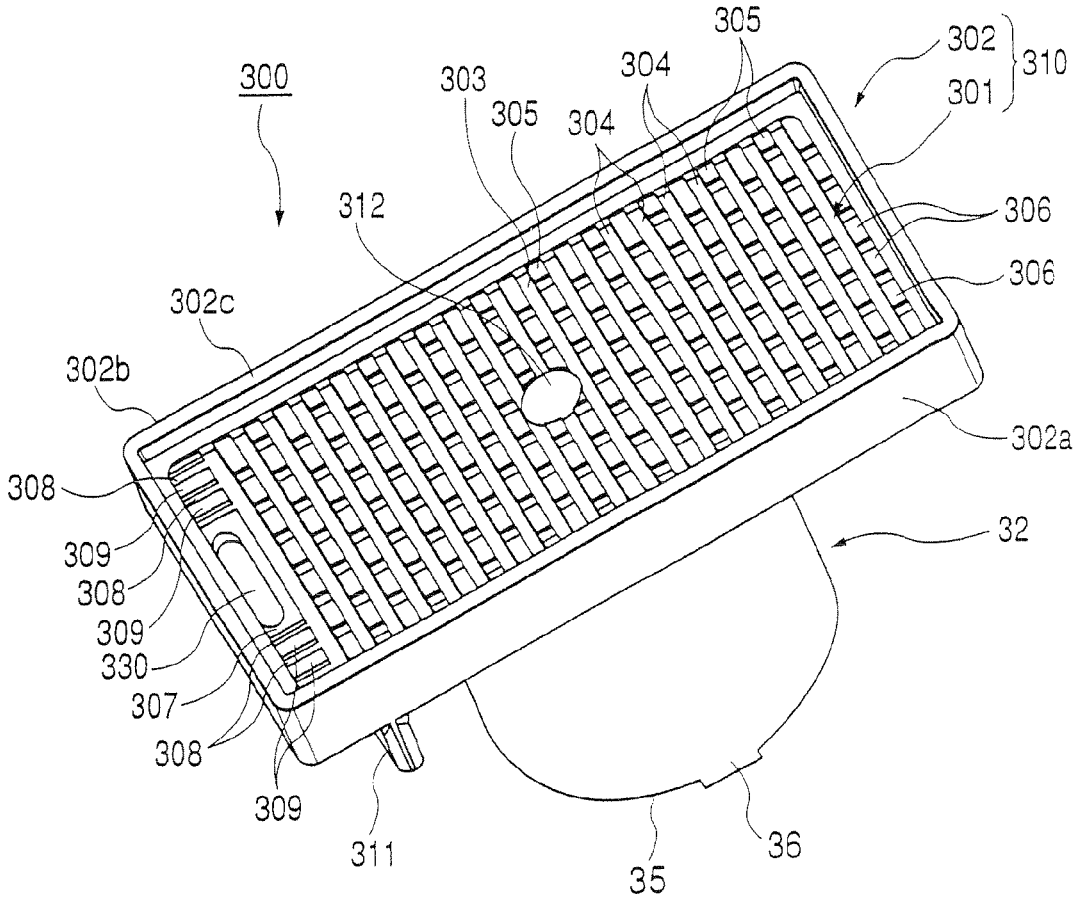
FIG. 12 is a view showing a partitioning member according to a third embodiment of the invention.
Figure 13A:
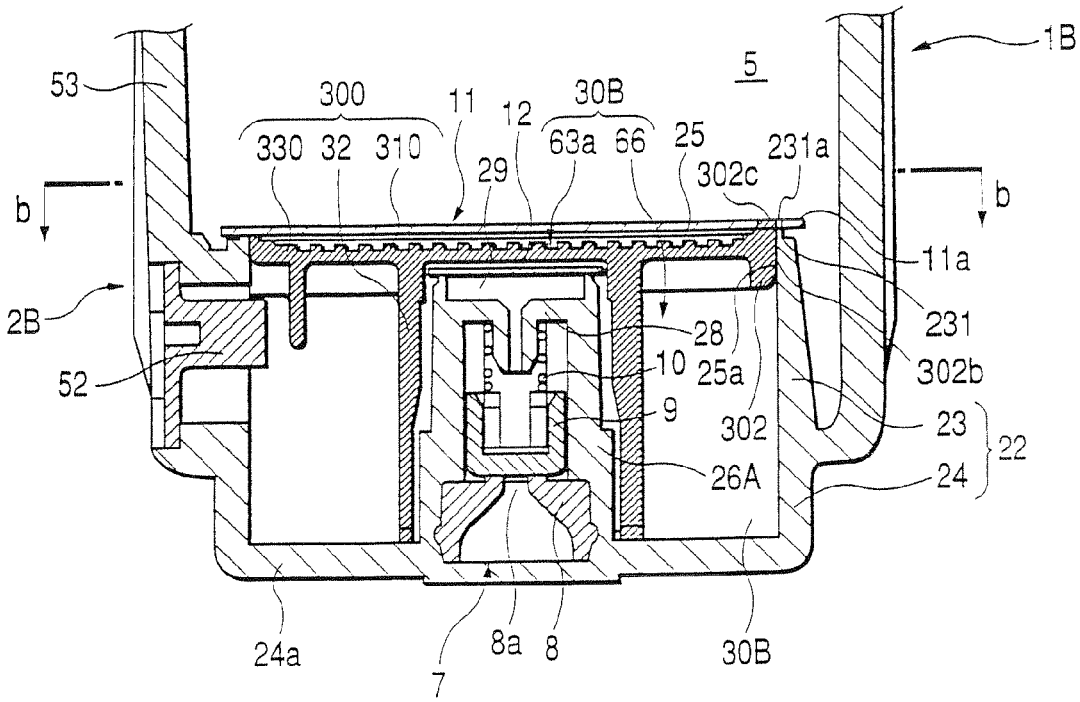
FIG. 13(*a*) shows an ink tank according to the third embodiment of the invention, and is a partially enlarged, cross sectional view taken on line V-V in FIG. 1, and FIG. 13(*b*) is a partially enlarged, longitudinal sectional view showing a portion of the ink tank, except a first filter.
Figure 13B:
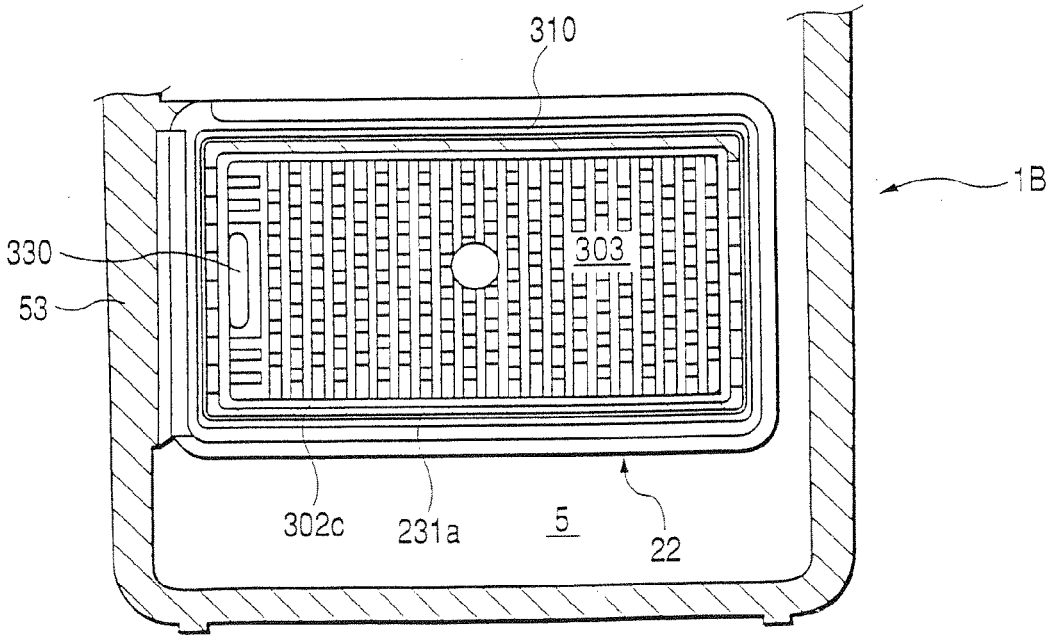
Figure 14A:
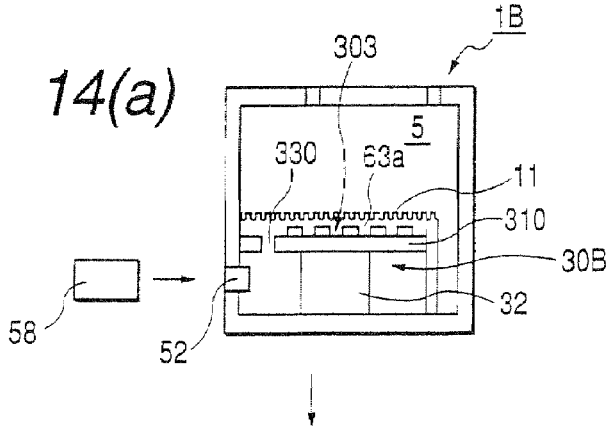
FIGS. 14(*a*) to (*e*) are explanatory diagrams for explaining operations and advantages of the partitioning member in the FIG. 13 ink tank.
Figure 14B:
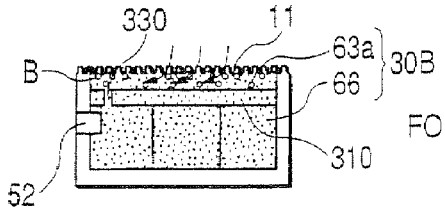
Figure 14C:
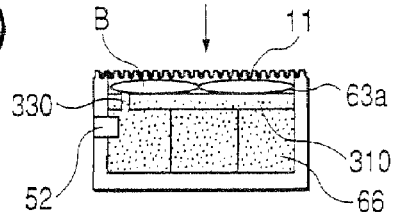
Figure 14D:
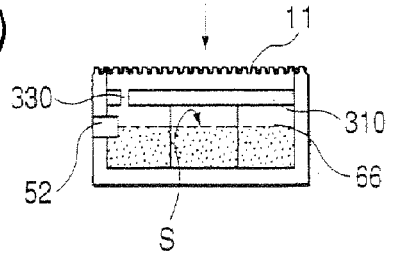
Figure 14E:
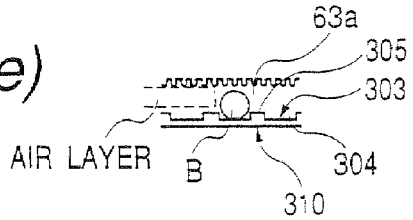

FIG. 12 is a view showing a partitioning member according to the third embodiment of the invention. FIG. 13(*a*) shows an ink tank according to the third embodiment of the invention, and is a partially enlarged, cross sectional view taken on line V-V in FIG. 1. FIG. 13(*b*) is a partially enlarged, longitudinal sectional view showing a portion of the ink tank, except a first filter. FIG. 14 is an explanatory diagram for explaining operations and advantages of the partitioning member in the FIG. 13 ink tank.

As shown in FIGS. 12 and 13, the partitioning member 300 includes a partitioning plate part 310 which partitions the interior of the sub ink chamber 20, and a cylindrical part 32 vertically extending from the central part of the lower side of the partitioning plate part. The sub ink chamber 30 includes a rectangular partitioning plate main body 301, and a rectangular outer peripheral frame 302 which extends from the peripheral end of the partitioning plate main body 301 in vertical directions. An outer peripheral surface 302*a* of the outer peripheral frame 302 is liquid tightly jointed to an inner peripheral surface 25*a*, closer to the communication port 25, of a rectangular cylindrical frame 22 forming the sub ink chamber 20. A surface of the partitioning plate main body 301

(surface closer to the bubble storage part 63*a*) is an irregular surface 303. The irregular surface 303 functions as a bubble trap which captures air bubbles so as to prevent air bubbles formed by air having flowed from the main ink chamber 5 into the bubble storage part 63*a* via the first filter 11, from flowing to the ink introducing hole 330.

The irregular surface 303 of the embodiment is formed such that depressions 304 and protrusions 305, which are fixed in width and extend in the short side direction, are alternately arrayed in the long side direction at fixed intervals. Second protrusions 306, each having a fixed length, are discretely formed on the surface of each protrusion 305 at fixed intervals.

When viewed in the long side direction of the partitioning plate main body 301, the second protrusions 306 discretely formed on the surface of each protrusion 304 are arrayed in a zig-zag fashion. As measured from the depressions 304, a height of each protrusion 305 is, for example, 0.1 mm and a height of each second protrusion 306 provided on the protrusion 305 is, for example, 0.2 mm. The depressions 304 and the protrusions 305 are, for example, 0.5 mm in width.

An elliptic ink introducing hole 330, long in the short side direction, is formed at the central part of an end of the partitioning plate main body 301, when viewed in the long side direction of the partitioning plate main body 301, at which the right-angled prism 52 is located. The ink introducing hole 330 is surrounded by a protruded frame part 307 of a height equal to that of the second protrusion 306. Elongated depressions 308 and elongated protrusions 309, which have fixed lengths and extend in the long side of the partitioning plate main body 301, are alternately arrayed at fixed intervals in the short side direction in the spaces between the protruded frame part 307 and one of the long sides of the partitioning plate main body 301 and between the protruded frame part and the other long side. A height of the elongated protrusion 309 is equal to that of the second protrusion 306.

A circular depression part 312 is present at the central part of the partitioning plate main body 301. The partitioning member 300 of this instance is an injection-molded product of synthetic resin. The circular depression part 312 is a gate mark. A hanging wall part 311, which is extended to a position below a center position of the vertical side of the right-angled prism 52, is formed on the lower side surface of the partitioning plate main body 301 (surface of the partitioning plate main body closer to the ink storage part 66). The hanging wall part 311 extends over an overall width of the partitioning member 300 in the short side direction.

A cylindrical part 32, which vertically extends at the central part of the lower side surface of the partitioning plate main body 301, sucks up ink stored on the bottom of the ink storage part 66 to the circular communication port 29 to which the second filter 12 located in the upper part is mounted, and it functions as the cup-like cap 31 in the second embodiment.

The partitioning member 300 is joined to an opening at the upper end of the cylindrical frame 22 which defines the sub ink chamber 20, in the following way. As understood by FIGS. 13(*a*) and 13(*b*), when the cylindrical part 32 is applied from above, and attached to the cylindrical protruded part 26A in the ink storage part 66 in a capping fashion, the outer peripheral surface 302*a* of a fringe part 302*b* (peripheral edge part) of the outer peripheral frame 302 of the partitioning plate part 310 is brought into close contact with the inner peripheral surface 25*a* of a rectangular frame part 231 of a narrow width (outer peripheral wall part), while the upper end opening of the cylindrical frame 22 is fit, at the edge part, into the rectangular frame part 231.

A rectangular-frame like end face 231*a* of the rectangular frame part 231 of the cylindrical frame 22 and a rectangular-frame like end face 302*c* of an end part 302*a* of the partitioning member 300 are disposed be flush with each other. An outer peripheral part 11*a* of the first filter 11 is put on those end faces, and thermally fused to the latter simultaneously. In this way, those three members are joined together by the thermal fusion process. As a result, a space between the outer peripheral surface 302*b* of the outer peripheral frame 302 of the partitioning member 300 and the inner peripheral surface 25*a* of the cylindrical frame 22 are liquid tightly sealed.

Next, the operations and advantages of the ink tank thus constructed will be described.

In the ink tank 1B of the instant embodiment, the bubble storage part 63*a* is formed in the partitioning plate part 310 of the partitioning member 300. The bubble storage part 63*a* separates ink liquid from air bubbles, and only the ink liquid lowers through the ink introducing hole 330. Even if the air bubbles pass through the ink introducing hole 330, the air bubbles, together with the ink liquid, are surely moved downward and an ink end state is exactly and surely detected since the ink introducing hole 330 is provided only in the reflecting surfaces 52*a* and 52*b* side, and those are made to pass through the ink passage defined by the reflecting surfaces 52*a* and 52*b*.

Further detailed description will be given with reference to FIG. 14. When an amount of residual ink is small and the ink liquid level lowers to below the height position of the first filter 1, air derived from the main ink chamber 5 flows into the bubble storage part 63*a* of the sub ink chamber 20 to form air bubbles B. The formed air bubbles B are progressively accumulated in the sub ink chamber 20. This state is shown in FIG. 14(*b*).

Next, when the ink liquid surface lowers to a position lower than the lower end of the bubble storage part 63*a*, the amount of residual ink, which forms air bubbles, in the bubble storage part 63*a*, is extremely small. The bubble storage part 63*a* and the ink storage part 66 are connected only through the thin, ink introducing hole 330, and there exists little chance that the ink for forming air bubbles is supplied from the ink storage part 66 to the bubble storage part 63*a*. Further, the outer peripheral surface 302*a* of the partitioning plate part 310 of the partitioning member 300 is joined to the inner peripheral surface 25*a* of the cylindrical frame 22 in a liquid-tight state. There is no chance that the ink is supplied from the ink storage part 66 to the bubble storage part 63*a* through them.

As a result, even when the air output from the main ink chamber 5 enters there, formation of air bubbles B stops since the amount of ink is substantially zero in the bubble storage part 63*a*. The already formed air bubbles are broken and shrink in volume, and an air layer is gradually formed from the upper end side of the bubble storage part 63*a* to the lower side. This state is shown in FIG. 14(*c*).

Thus, the air bubble forming ink is not supplied from the ink storage part 66 to the bubble storage part. Accordingly, the air bubbles stored in the bubble storage part 63*a* are gradually broken in the bubble storage part 22, with lowering of the ink liquid surface, and a layer consisting of only air is formed in its upper end part. Thereafter, the ink liquid surface gradually lowers in a state that no air bubble is formed. This state is shown in FIG. 14(*d*).

As mentioned, in the instant embodiment, the irregular surface 303 for capturing the air bubbles is formed on the surface of the partitioning plate part 310 of the partitioning member 300. Air bubbles that are formed by the air coming from the main ink chamber 5 to the bubble storage part 63*a*, together with the ink, will flow in the bubble storage part 63*a* toward the ink introducing hole 330. However, as shown in FIG. 14(*e*), the air bubbles B are captured by the depressions 304 of the irregular surface 303 formed on the surface of the partitioning plate part 310, and their movement is blocked. When air bubbles are further formed in a state that the air bubbles are not moved, newly formed air bubbles combine with the air bubbles that are captured by the depressions 304 and standstill, to thereby grow air bubbles larger than the newly formed bubbles.

Thus, the movement of the air bubbles generated is blocked by the irregular surface 303 for capturing air bubbles, and the coupling of the air bubbles is promoted. As a result, the formation of the air layer in the bubble storage part 63*a* of the sub ink chamber 20 is promoted, and a separation state of the air bubbles from the ink liquid surface is swiftly set up. Accordingly, such an unwanted situation that the air bubbles flow into the ink storage part 66, and attach to the reverse surfaces of the reflecting surfaces 52*a* and 52*b*, and the ink end detection is impossible, is surely avoided.

Particularly, in the embodiment, the depressions 304 and the protrusions 305, which are formed on the irregular surface 303 of the partitioning plate part 310 of the partitioning member 300, are arrayed in a direction substantially orthogonal to the flow of the air bubbles flowing to the ink introducing hole 330. The depressions 304 and the protrusions 305 are formed over substantially the entire surface of the irregular surface 303, while being arrayed in the short side direction orthogonal to the flow of ink flowing to the ink introducing hole 330, which is formed at the edge of the short side of the irregular surface 303. The elongated depressions 308 and elongated protrusions 309, which extend in the long side direction of the irregular surface 303, are formed between the ink introducing hole 330 and the long side edges of the irregular surface 303. Accordingly, the flow of the air bubbles can efficiently be blocked by the irregular surface 303. If required, the depressions and the protrusions may be arrayed arcuately at given intervals in a concentric fashion about the ink introducing hole 330.

In the embodiment, the second protrusions 306, higher than the others, are discretely formed on the surface of each protrusion 305. Those second protrusions 306 are arrayed in a zig-zag fashion when viewed in the long side direction of the partitioning member 300 as the ink flow direction, viz., flow direction of the air bubbles. With this, when the amount of residual ink is small, it flows through spaces among the protrusions and depressions formed on the irregular surface 303. Since the second protrusions 306 are arrayed in a zig-zag fashion, the ink zig-zag flows along the surface parts of the protrusions 305 left in a zig-zag fashion among the second protrusions 306.

Accordingly, the air bubbles which will move together with the ink are reliably captured by the irregular surface 303. Further, the air bubbles are reliably captured by the deeper depressions 304 formed among the second protrusions 306. An amount of ink left in the irregular surface 303 is not determined by the height of the second protrusions 306, but determined by the height of the low protrusions 305. Therefore, the amount of residual ink in the irregular surface 303 is reduced.

In the embodiment, it is preferable that the interval between the first filter 11 and the irregular surface 303 of the partitioning member 300 is selected to be smaller than a diameter of each air bubble generated in the bubble storage part 63*a*. If so selected, the air bubbles generated in the bubble storage part 63*a* are crushed to be flat. Therefore, the air bubbles are reliably captured on the irregular surface 303 of the partitioning member 300. The binding of the air bubbles is advantageously facilitated.

Thus, in the ink tank 1 of the embodiment, reflecting states of the reflecting surfaces 52*a* and 52*b* surely vary without any interference by the air bubbles, with lowering of the ink liquid surface. Accordingly, in the ink jet printer 91 using the ink tank 1 of the embodiment as an ink supplying source, an ink end state in the ink tank is certainly detected based on the reflecting states of the reflecting surfaces 52*a* and 52*b*.

Further, if the partitioning member is formed integrally with the top plate of the cup-like cap 31A, the container body 2B is simple in shape, and its molding is easy.

As described above, in the ink tank of the embodiment, a sub ink chamber is formed between a main ink chamber which contains a foam absorptively retaining ink and is opened to the air, and an ink outlet for drawing out ink to exterior. The interior of the sub ink chamber is partitioned into a bubble storage part closer to the main ink chamber and a bubble storage part closer to the ink outlet. An ink end state is detected by the utilization of the reflecting surfaces disposed such that the reverse surfaces thereof are exposed to the ink storage part. The irregular surface for capturing air bubbles is formed on the surface of the partitioning member, which marks off the boundary between the bubble storage part and the ink storage part.

The ink liquid surface, which lowers with decrease of the residual ink, is separated from air bubbles formed by air flowing from the ink tank to the bubble storage part by the partitioning member. The irregular surface of the partitioning member captures air bubbles generated in the bubble storage part, and blocks the flowing of them to the bubble storage part. Accordingly, there is no occurrence of such an unwanted situation that air bubbles attach to the reflecting surfaces of which the reverse surfaces are exposed to the ink storage part or air bubbles stray in the vicinity of the reflecting surfaces, and as a result, reflecting states of the reflecting surfaces do not vary. Accordingly, sure detection of the ink end in the ink tank is secured.

In the invention, the protrusions and depressions of the irregular surface of the partitioning member are arrayed in a direction orthogonal to the flow of air bubbles flowing to the ink introducing hole, the flowing of air bubbles is blocked and air bubbles are surely captured.

Further, in the invention, the protrusions and depressions are alternately formed on the irregular surface, and second protrusions, which are discrete and high, are formed on the protrusions, respectively. In this case, air bubbles are surely captured by deep depressions formed among the depressions and the second protrusions, and ink may flow through the spaces among the discrete second protrusions. Accordingly, the air bubbles are surely captured, and the amount of ink left on the irregular surface is reduced.

In the invention, the depressions and the protrusions on the irregular surface are arrayed in a zig-zag fashion when viewed in a direction of a flow of air bubbles flowing to the ink introducing hole. In the structure, along the protrusions and the depressions, which are arrayed in a zig-zag fashion, the ink flows also in a zig-zag fashion. This ensures the capturing of air bubbles. Further, there is no chance that the ink stays on the irregular surface.

Also in the embodiment, a space between an inner peripheral surface of the first sub ink chamber and an outer peripheral surface of the partitioning member is liquid tightly sealed. This characteristic feature prevents the supplying of the bubble forming ink from the ink storage part to the bubble storage part. The result is to enhance the ability of the partitioning member to separate the air bubbles from the ink liquid surface.

A height of the bubble storage part is smaller than a diameter of each air bubble generated there. The air bubbles generated in the bubble storage part are crushed to be flat. Accordingly, the air bubbles are surely captured on the irregular surface of the partitioning member, and the bonding of air bubbles is enhanced.

In this case, the outer peripheral part of the first filter is joined to the outer peripheral wall of the sub ink chamber and the outer peripheral edge of the partitioning member by a single thermal fusion process, thereby liquid tightly sealing the space between an inner peripheral surface of the first sub ink chamber and an outer peripheral surface of the partitioning member. Accordingly, the joining of those three members and the liquid tight state are realized by a simple manufacturing process.

The ink jet printer of the invention uses, for its ink supply source, the ink tank having the reflecting surfaces whose reflecting states surely vary with the lowering of the ink liquid surface. Accordingly, an ink end state in the ink tank can surely be detected based on the reflecting states of the reflecting surfaces.

It should be understood the invention is not limited to the embodiments and others as described above, but may variously be modified, altered and changed within the true spirit of the invention.

For example, in the third embodiment, the ink introducing hole 330 ranging from the bubble storage part to the ink storage part is formed in the partitioning member. Alternatively, the ink introducing hole may be defined by the opposed surfaces of the partitioning member and the right-angled prism 52, and the partitioning member and the side plate 53.

In the third embodiment, the right-angled prism 52 is located in the ink passage. The prism may be located in the ink storage part since the air bubbles flow thereinto from the bubble storage part.

Further, in the embodiments 1 and 2, the partitioning parts 61 and 71 may be separate members as in the third embodiment. If so done, the container body is simple in shape, and its molding is easy.

While in the embodiment, the ink tank uses the foam for the ink absorbing member, a bundle of fibers or felt may be used instead of the foam.

As seen from the foregoing description, in an ink tank of the invention, an ink passage is formed in the interior of a sub ink chamber, whereby ink and air bubbles having flowed from a main ink chamber to the sub ink chamber are led to the reverse surfaces of right-angled prisms for ink end detection. Accordingly, the air bubbles entering the sub ink chamber are surely led to the reverse surfaces of the prisms.

Accordingly, at the ink passage defined by the reflecting surfaces, the ink liquid level surely lowers with decrease of the amount of residual ink. As such, sure ink end detection is secured.

A width of the ink passage defined by the reflecting surfaces is selected to be narrower than a diameter of an air bubble generated within the sub ink chamber. With the dimensional selection, the air bubbles having flowed into the ink passage are crushed and pressed against the reflecting surfaces in a surface contact state. As a result, such an unwanted situation that even though the ink liquid level lowers, the reflecting surfaces 52*a* and 52*b* remains covered with ink retained in the spaces among the air bubbles, and it is impossible to detect the ink end, is avoided.

In the ink jet printer using the ink tank constructed according to the invention as an ink supplying source, sure detection of the ink end in the ink tank can be secured.

What is claimed is:

1. An ink tank comprising:

a first ink chamber adapted to be opened to an external environment;

a second ink chamber;

an ink passage by which the first ink chamber communicates with the second ink chamber;

an ink outlet communicating with the second ink chamber; and a detector element arranged so as to face at least one of the ink passage and the second ink chamber, the detector element operable to detect a level of ink, wherein the ink passage includes a trap passage which is disposed upstream of the detector element and is configured to trap air bubbles in the ink.

2. The ink tank as set forth in claim 1, wherein the second ink chamber communicates with the ink passage at a position above the detector relative to a direction of gravity.

3. The ink tank as set forth in claim 1, further comprising a partition member positioned between the first and second ink chambers, the partition member serving to define the ink passage and to form a part of the trap passage.

4. The ink tank as set forth in claim 1, further comprising:

a protrusion protruding from an inner face of the second ink chamber, the protrusion having a hole communicating the second ink chamber with the ink outlet; and a valve operable to seal the hole.

5. The ink tank as set forth in claim 1, further comprising a filter disposed between the first and second ink chambers.

6. The ink tank as set forth in claim 1, wherein the detector element is operable to optically detect a condition of the ink, and wherein the detector element has a couple of reflecting surfaces arranged so that light emitted from a light emitting element is absorbed by the ink when the couple of reflecting surfaces is in contact with the ink and reflected to a light receiving element when the couple of reflecting surfaces is not in contact with the ink.

7. The ink tank as set forth in claim 1, wherein the detector element is provided in the ink passage by which the first ink chamber communicates with the second ink chamber.

8. The ink tank as set forth in claim 1, wherein the trap passage includes a zigzag passage configured to flow the ink in a zigzag manner.

9. The ink tank as set forth in claim 1, wherein the second ink chamber is disposed below the first ink chamber relative to a direction of gravity.

10. The ink tank as set forth in claim 1, wherein the trap passage is configured to change a direction in which the ink flows to trap the air bubbles in the ink.

11. An ink tank comprising:

a first ink chamber adapted to be opened to an external environment;

a second ink chamber communicating with the first ink chamber so that ink is supplied from the first ink chamber to the second ink chamber; and a detector element arranged so as to face the second ink chamber, the detector element operable to detect a level of the ink, wherein the second ink chamber includes a trap passage which is configured to trap air bubbles in the ink, wherein the trap passage is disposed upstream of the detector element in an ink flow direction.

* * * * *